US006833544B1

(12) United States Patent
Campbell et al.

(10) Patent No.: US 6,833,544 B1
(45) Date of Patent: Dec. 21, 2004

(54) METHOD AND APPARATUS FOR MULTIPLE STAGES OF MASS SPECTROMETRY

(75) Inventors: Jennifer Campbell, Somerville, MA (US); Bruce Collings, Bradford (CA); Donald J. Douglas, Vancouver (CA)

(73) Assignee: University of British Columbia, Vancouver (CA)

( * ) Notice: Subject to any disclaimer, the term of this patent is extended or adjusted under 35 U.S.C. 154(b) by 0 days.

(21) Appl. No.: 09/857,234

(22) PCT Filed: Nov. 30, 1999

(86) PCT No.: PCT/CA99/01142

§ 371 (c)(1),
(2), (4) Date: Apr. 1, 2002

(87) PCT Pub. No.: WO00/33350

PCT Pub. Date: Jun. 8, 2000

(30) Foreign Application Priority Data

Dec. 2, 1998 (CA) ..... 2255188

(51) Int. Cl.[7] ..... H01J 49/42

(52) U.S. Cl. ..... 250/282; 250/281; 250/284; 250/288; 250/290; 250/423 R; 250/423 P

(58) Field of Search ..... 250/281, 282, 250/284, 285, 286, 287, 288, 290, 292, 397, 423 R, 423 P, 423 F, 424, 425

(56) References Cited

U.S. PATENT DOCUMENTS 4,755,670 A 7/1988 Syka et al.
5,179,278 A 1/1993 Douglas (List continued on next page.)

FOREIGN PATENT DOCUMENTS

WO WO97/07530 2/1997
WO WO99/30350 6/1999

OTHER PUBLICATIONS

Yu–Luan Chen, B.A. Collings, and D.J. Douglas, Collision Cross Sections of Myoglobin and Cytochrome c Ions with Ne, Ar, and Kr, J. Am. Soc. Mass Spectrom., (1997). Pp 681–687.

A.V. Loboda, A.N. Krutchinsky, V. Spicer, W. Ens and K.G. Standing, Selective Collision Induced Dissociation by Resonance Excitation in RFquadrupoles at Elevated Pressures, Proceedings of the 46th AMS Conference on Mass Spectrometry Topics (Orlando 1998) at 37.

Watson, J.T. et al., "Technique for Mass Selective Ion Rejection in a Quadrupole Reaction Chamber", International Journal of Mass Spectrometry and Ion Processes, vol. 93 (Amsterdam: 1989) at 225–235.

Dudonov, A. et al., "A Technique for Decomposition of Selected Ions in Molecule Iron Reactor Coupled with Ortho-Time–Of–Flight Mass Spectrometry", Rapid Communications in Mass Spectrometry, vol. 11 (London: 1997) at 1649–1656.

*Primary Examiner*—John R. Lee
*Assistant Examiner*—David A. Vanore
(74) *Attorney, Agent, or Firm*—Daniel C. Abeles; Eckert Seamans Cherin & Mellott, LLC

(57) ABSTRACT

A method of and apparatus for analyzing a stream of ions first subjects astream of ions to a first mass analysis step, to select ions having a mass-to-charge ratio in a first desired range; this enables a mass analyzer with highresolution to be used. The selected ions are then passed into a radiofrequency linear ion trap containing a gas. The trapped ions are caused to collide with the gas, either by being injected with a high axial energy or by application of external excitation to cause fragmentation. Fragment ions of a given mass-to-charge ratio can then be isolated and excited to produce fragments of fragments. This process can be repeated to give multiple steps of mass spectrometry, $MS^n$. The fragment ions, and undissociated precursorions are then passed out of the linear ion trap and subjected to a further mass analysis step, for example in a time of flight device, to determine the mass spectrum of the ions.

45 Claims, 14 Drawing Sheets

U.S. PATENT DOCUMENTS 5,420,425 A 5/1995 Bier et al.
6,011,259 A * 1/2000 Whitehouse et al. ..... 250/287
6,093,929 A * 7/2000 Javahery et al. ..... 250/282
6,111,250 A * 8/2000 Thomson et al. ..... 250/282
6,483,109 B1 * 11/2002 Reinhold et al. ..... 250/292
6,504,148 B1 * 1/2003 Hager ..... 250/282

* cited by examiner 2500
1500
500
2500
1500
500
300
400
500
600
700
800
900

METHOD AND APPARATUS FOR MULTIPLE STAGES OF MASS SPECTROMETRY

FIELD OF THE INVENTION

This invention relates to multiple stage mass spectrometers which have two mass analyzers, and this invention is more particularly concerned with both a method of and an apparatus for providing multiple stages of mass spectrometry ($MS^n$) capabilities in such spectrometers.

BACKGROUND OF THE INVENTION

Tandem mass spectrometry is widely used for trace analysis and for the determination of the structures of ions. In tandem mass spectrometry a first mass analyzer selects ions of one particular mass to charge ratio (or range of mass to charge ratios) from ions supplied by an ion source, the ions are fragmented and a second mass analyzer records the mass spectrum of the fragment ions. In a triple quadrupole mass spectrometer system, this effects MS/MS. For example, ions produced in an atmospheric pressure source, pass through a region of dry nitrogen and then pass through a small orifice, into a region at a pressure of about 5 torr (0.7 kPa). Ions then pass through a quadrupole ion guide, operated at a pressure of about $7\times10^{-3}$ torr ($9.1\times10^{-4}$ kPa) into a first quadrupole mass filter, operated at a pressure of about $2\times10^{-5}$ torr ($2.6\times10^{-6}$ kPa). Precursor ions mass selected in the first quadrupole are injected into a collision cell filled with gas, such as argon, to a pressure of $10^{-4}$ to $10^{-2}$ torr ($1.3\times10^{-5}$ to $1.3\times10^{-3}$ kPa). The collision cell contains a second quadrupole ion guide, to confine ions to the axis. Ions gain internal energy through collisions with the gas and then fragment. The fragment ions and any undissociated precursor ions then pass into a second mass analyzer, and then to a detector, where the mass spectrum is recorded.

Triple quadrupole systems are widely used for tandem mass spectrometry. One limitation is that recording a fragment mass spectrum can be time consuming because the second mass analyzer must step through many masses to record a complete spectrum. To overcome these limitations, QqTOF systems have been developed. This system is similar to the triple quadrupole system but the second mass analyzer is replaced by a time-of-flight mass analyzer, TOF. The advantage of the TOF is that it can record $10^4$ or more complete mass spectra in one second. Thus for applications where a complete mass spectrum of fragment ions is desired the duty cycle is greatly improved with a TOF mass analyzer and spectra can be acquired more quickly. Alternatively for a given measurement time, spectra can be acquired on a smaller amount of sample.

A further known technique is the coupling of electrospray ionization (ESI) to time-of-flight mass spectrometers (TOFMS), and this is an attractive technique for mass spectrometry. ESI is a soft ionization technique capable of forming ions from a broad range of biomolecules, while TOFMS has the well known advantages of rapid mass scanning, high sensitivity, and a theoretically limitless mass range. However, ESI and TOFMS are, in one way, incompatible as a source/analyzer pair: ESI creates a continuous stream of ions and TOFMS requires pulsed operation. Thus in the simplest coupling of ESI to TOFMS there is a very poor duty cycle, with less than 1% of the ions formed being detected and early work in this field was predominantly concerned with increasing the duty cycle.

Within the past two years, literature on ESI-TOFMS has begun to focus on tandem mass spectrometry (MS/MS) with hybrid instruments. The fragmentation of ions in these systems is achieved via traditional methods for collision induced dissociation (CID). Tandem-in-space systems termed quadrupole-TOF's or "Qq-TOF's", as noted above, are analogous to triple quadrupole mass spectrometers—the precursor ion is selected in a quadrupole mass filter, dissociated in a radiofrequency- (RF-) only multipole collision cell, and the resultant fragments are analyzed in a TOFMS. Tandem-in-time systems use a 3-D ion trap mass spectrometer (ITMS) for selecting and fragmenting the precursor ion, but pulse the fragment ions out of the trap and into a TOFMS for mass analysis.

It is sometimes desirable to perform multiple stages of tandem spectrometry termed $MS^n$. In $MS^3$ for example, a precursor ion is selected in a first mass analyzer and dissociated to produce fragment ions. A fragment ion of a particular mass to charge ratio is then isolated and dissociated again to produce fragments of the fragment. The mass spectrum of these is then recorded. Multiple stages of MS are useful when insufficient dissociation can be produced in a first stage of MS/MS or to elucidate dissociation pathways of complex ions. The latter for example is especially useful to sequence peptides and other biomolecules by mass spectrometry.

The triple quadrupole system and QqTOF system described above provide only one stage of MS/MS and do not allow $MS^n$. In particular such systems do not provide for trapping of ions.

In one known proposal, in PCT application WO 98/06481 from Analytica of Brantford, there is a described system including ion trapping. Ions from a source are injected into a multipole ion guide, and ions of one m/z or range of m/z are then isolated in the ion guide by applying resonant excitation or AC/DC voltages to the ion guide and trapping voltages at either end. The ion is then fragmented in the same ion guide, which can be operated as a linear ion trap (LM. No mass analyzer is placed before the ion guide. This is a distinct disadvantage, since a multipole ion guide used both for ion isolation and mass analysis has a relatively low resolution. For example, the present inventors have found that using a LIT as described by Analytica the resolution in isolating an ion is ca. 100. With a separate quadrupole mass filter or other mass analyzer before the ion trap the resolution can be many thousand. The relatively low resolution for ions introduced into the multipole ion trap may derive from at least two sources: (1) the pressure is relatively high ($10^{-3}$–$10^{-1}$ torr ($1.3\times10^{-4}$ to $1.3\times10^{-2}$ kPa) as described in the PCT application); and (2) in the system described in the PCT application the gas is either nitrogen or air that flows in from the ion source. This has a greater damping effect on ion motion in the LIT than lighter gases such as helium, and gives relatively poor resolution for resonant excitation of ions. Such a system does not readily enable the pressure and type of gas in the LIT to be adjusted to provide optimum conditions for $MS^n$.

Additionally, there have been some recent examples of proposals using resonant excitation in RF-only quadrupoles for CID with fragment mass analysis by TOFMS. Dodonov et al (Rap. Comm. Mass Spectrometry 11, 1649–1656 (1997)) introduced a molecular ion reactor (MIR) consisting of a segmented RF-only quadrupole with a longitudinal electrical field which is operated at a high pressure. Depending on the mode of operation, CID was accomplished through either increasing the RF or DC voltages along the segments. However, no trapping of ions was demonstrated.

Loboda et al (proceedings of the 46th ASMS Conference on Mass Spectrometry and Allied Topics, Orlando, Fla., May 31–Jun. 4, 1998, MOD. 11: 55) modified the RF drive of the collision cell in a Q-TOFMS to apply quadrupolar excitation to ions flowing through the cell, inducing fragmentation. No trapping of ions was demonstrated. It was suggested that a 2D trap might be formed to isolate precursor ions, but it was not stated if this was to be done before or after a stage of mass analysis.

B. A. Thomson et al, in PCT application PCT/CA96/00541, describes a method and apparatus for speeding up the passage of ions through various stages of a mass spectrometer, such as the ion guide and the collision cell. The increase in ion speed is achieved via an axial DC field which can be created through various multipole rod configurations. The axial DC field also aids in the dissociation of ions in collision cells by oscillating the ions axially about their equilibrium positions. However, Thomson states that there is no need to operate at the resonant frequency of the ions or even at a harmonic of the resonant frequency of the ions.

J. D. Watson et al, in an article entitled "*A Technique for Mass Selective Ion Rejection in a Quadrupole Reaction Chamber*" (International Journal of Mass Spectrometry and Ion Processes, 93, 225–235, 1989) described trapping and resonant ejection of an ion from the quadrupole collision cell of a triple quadrupole mass spectrometer. The intent was to study reaction kinetics of trapped ions. While there is no specific teaching of resonant excitation of trapped ions without ejection, there is speculation that this might be possible.

In mass spectrometry, the linear ion trap has remained relatively unexplored. U.S. Pat. Nos. 4,755,670 and 5,420,425, both assigned to the Finnigan Corporation, relate to a Fourier transform quadrupole and new ion trap geometries respectively, and they both mention a LIT. U.S. Pat. No. 5,179,278 (D. J. Douglas) suggests using a LIT as an "ion bottle" to improve the duty cycle of a 3D ITMS.

SUMMARY OF THE INVENTION

In accordance with a first aspect of the present invention, there is provided a method of analyzing a stream of ions, the method comprising:

(1) subjecting a stream of ions to a first mass analysis step, to select ions having a mass-to-charge ratio in a first desired range;

(2) passing ions in the selected range into a radio frequency linear ion trap containing gas;

(3) trapping the selected ions in the linear ion trap and exciting the ions to cause collisions with the ambient gas and fragmentation;

(4) subjecting the fragmented ions to a secondary excitation, different from the first excitation, to cause excitation and fragmentation of selected fragment ions; and (5) passing the ions out of the linear ion trap and subjecting the ions to a further mass analysis step to determine the mass spectrum of the ions.

Passing the ions, in step (2) into the radio frequency ion trap can be done either: with a relatively low energy, so no fragmentation occurs in the LIT until additional excitation is applied; or with a relatively high energy in the axial direction, so that fragmentation occurs simply due to the high energy of the ions entering the LIT and colliding with the gas.

Thus a variant of the basic method of the present invention comprises passing the ions into the linear ion trap with sufficient energy to promote collision induced dissociation, said energy providing the excitation of (3), whereby step (3) comprises applying a signal to the linear ion trap to trap ions, before subjecting the ions to the further mass analysis of step (5).

In either case, once the ions have entered the LIT, have been excited, by either technique, to cause fragmentation, one then has fragmentions, with any remaining precursor ions trapped in the LIT. These ions can then be discharged for further mass analysis, or subject to multiple steps of mass selection and excitation to cause fragmentation, before being discharged for the final mass analysis step.

Thus, the method advantageously includes, in step (4), subjecting the fragmented ions to a secondary excitation, different from the first excitation, to cause excitation and fragmentation of selected fragment ions ($MS^3$). This can be repeated to achieve further steps of $MS^n$ (n greater than 3). Further, prior to the additional step of secondary excitation, applying a signal to the linear ion trap, to select ions having a mass-to-charge ratio in a second desired range, wherein the secondary excitation step comprises exciting ions in the second desired range.

Thus, the method can include, while trapping the ions in the linear ion trap, effecting multiple cycles of:

(1) selecting ions having a mass-to-charge ratio in a desired range; and (2) exciting the selected ions to cause fragmentation.

The ions can be excited in the linear ion trap by providing an additional signal to the linear ion trap.

The further mass analysis step of step (5) can be carried out either in a quadrupole mass analyzer, or in a time of flight mass analyzer. For a time of flight mass analyzer, this can be arranged with its axis perpendicular to the axis of the linear ion trap.

Preferably, the first mass analysis step is carried out in a quadrupole mass analyzer which is coaxial with the linear ion trap.

More preferably; the method includes, prior to exciting the ions in step (3), subjecting the trapped ions to a signal comprising a plurality of excitation signals uniformly spaced in the frequency domain and having a notch, wherein the notch covers a desired frequency band and there are no excitation signals in the frequency band of the notch, and wherein the excitation signals have sufficient magnitude to excite and eject ions except for ions having an excitation frequency falling within the frequency band of the notch. For the case where the frequency of the trapping RF signal is 1.0 MHz, this can be achieved by applying a combination of signals having sine waves with frequencies in the range 10 to 500 kHz and spaced at 500 Hz intervals, and the frequency band of the notch then has a width of typically 1–10 kHz and is centered on the resonant frequency of an ion of interest. More generally, where the trapping RF frequency is f, then the auxiliary frequencies should be up to f/2.

In accordance with another aspect of the present invention, there is provided an apparatus, for effecting mass analysis and fragmentation of an ion stream, the apparatus comprising:

an input for an ion stream;

a first mass analyzer;

a radio frequency linear ion trap; and a final mass analyzer.

Preferably, the first mass analyzer comprises a quadrupole mass analyzer, and the final mass analyzer comprises a quadrupole mass analyzer, and the first mass analyzer, the linear ion trap and the final mass analyzer are axially aligned with one another.

The Radio frequency linear ion trap (LIT) could be formed in a number of ways. It could have aperture plates or lens at either end serving to provide the necessary D.C. potential gradient, to keep ions within the trap. Alternatively, where the ion trap is a multipole rod set, the rods can be segmented to permit different D.C. potentials to be applied to different segments. A segmented rods set also enables an axial D.C. field to be established.

For the final mass analyzer of the apparatus just defined and for the mass analysis step (4) of the method defined previously, the mass analyzer could be any suitable analyzer. Such an analyzer could be: a linear quadrupole, a linear or reflection TOF, a single magnetic sector analyzer; a double focusing two sector mass analyzer (having electric and magnetic sectors), a Paul trap (3D trap), a Wien filter, a Mattauch-Herzog spectrograph, a Thomson parabolic mass spectrometer, an ion cyclotron resonance mass spectrometer, etc.

The linear ion trap can be a multipole trap, but preferably includes a quadrupole rod set and the rods of the mass analyzers and of the linear ion trap preferably have substantially similar radii and substantially similar spacings.

The linear ion trap can have a pair of opposed x rods and a pair of opposed y rods, and then a main RF drive is connected to the x and y rods of the linear ion trap and an auxiliary drive is connected to at least one pair of rods of the linear ion trap. For example, the auxiliary drive is connected between the x and the y rods of the linear ion trap through a transformer, and the main RF drive is connected directly to the x rods of the linear ion trap and, through a coil of the transformer to the y rods. Alternatively, the auxiliary drive can be connected between the x rods. The apparatus preferably then includes an arbitrary waveform generator connected to the auxiliary drive, for applying a selected waveform to the linear ion trap to excite ions therein.

DESCRIPTION OF THE DRAWINGS

For a better understanding of the present invention and to show more clearly how it may be carried into effect, reference will now be made, by way of example, to the accompanying drawings in which.

DESCRIPTION OF THE PREFERRED EMBODIMENTS

Figure 1:
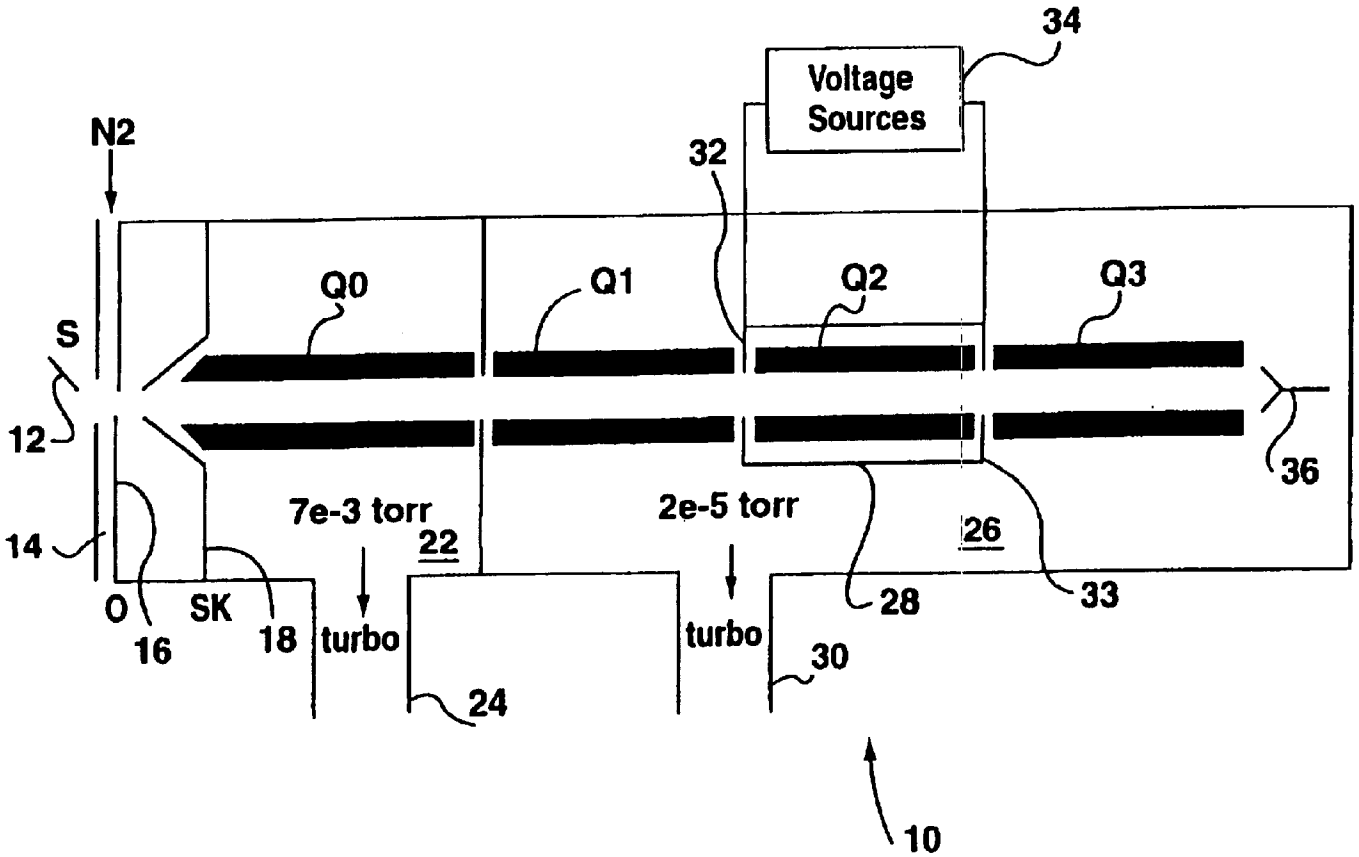
FIG. 1 is a schematic diagram of a mass spectrometer apparatus in accordance with the first embodiment of the present invention.

Referring first to FIG. 1, a mass spectrometer is indicated generally by the reference 10. Ions are generated by an ion source 12, which is a pneumatically assisted electrospray, and pass through a dry nitrogen "curtain gas", indicated at 14. The ions then pass through an orifice in plate 16, and then through a further orifice in a skimmer 18, into a first quadrupole rod set Q0.

The rod set Q0 is located in a first chamber 22 which is connected to a turbo molecular pump, with the connection indicated at 24. Although not shown, in known manner, the turbo molecular pump 24 is backed up by a rotary vane pump, which can also be connected to the region between the orifice plate 16 and the skimmer plate 18. Alternatively the region between the orifice and skimmer plates 16, 18 can be evacuated by a separate rotary vane pump.

The turbo molecular pump 24 maintains a pressure of $7\times10^{-3}$ torr ($9.1\times10^{-4}$ kPa) in the chamber 22, while a pressure of 2 torr (0.3 kPa) is maintained between the orifice and skimmer plates 16, 18. The rod set Q0 has just an RF voltage applied to it, so that it operates as an ion guide.

Ions then pass through into a main chamber 26 of the mass spectrometer. Within the main chamber 26, there are located first, second and third quadrupole rod sets, indicated at Q1, Q2 and Q3. A detector 36 is provided at the exit from the final rod set at Q3.

As indicated at 30, a connection to a suitable turbo molecular pump would be provided, again backed by the same rotary vane pump that backs turbo molecular pump 24. The pump 30 maintains a pressure of $2\times10^{-5}$ torr ($2.6\times10^{-6}$ kPa) in the main chamber 26.

The central quadrupole rod set Q2 is enclosed in a chamber or housing 28 and is provided with a connection for a gas (not shown), so that a higher pressure can be maintained typically at around 1–7 millitorr ($1.3\times10^{-4}$ to $9.1\times10^{-4}$ kPa).

Now, in accordance with the present invention, the housing or enclosure 28 with the rod set Q2 forms a linear ion trap. For this purpose, conductive plates with apertures are provided at the ends of the housing 28, which may be either separate from the housing 28 or integral therewith. These comprise an entrance plate 32 and an exit plate 33. The plates 32, 33 are conductive, insulated from another and connected to voltage sources 34.

Downstream from the housing 28 is a third quadrupole rod set, Q3, configured as a mass analyzer. For operation as a conventional triple quadrupole MS/MS system, the quadrupole rod sets Q0, Q1, Q2 and Q3 would be connected to conventional voltage sources, for supplying DC and RF voltages as required.

In use, ions generated from the ion source 12 pass into the quadrupole ion guide Q0. As noted, this is supplied with just RF voltages, to operate as an ion guide. Ions then pass through Q0 into the first quadrupole rod set Q1. This is supplied with suitable RF and DC voltages to operate as a mass filter, to select ions with a desired m/z ratio.

A mass selected precursor ion from the first rod set Q1 is then injected into the collision cell 28, to produce fragment ions as is known, by collision with a gas in the collision cell. If the energy with which the precursor ions enter the collision cell is low, they remain largely undissociated. The extent of ion fragmentation can be controlled by changing the injection ion energy and by changing the type and the pressure of the gas in Q2.

However, a blocking potential is applied to the exit plate 33. Consequently, these fragment ions are not immediately transmitted to the downstream rod set Q3. A blocking potential is then applied to the inlet 32 of the collision cell 28, to prevent additional ions entering the collision cell 28.

Under these conditions, the collision cell 28 forms a radio frequency linear ion trap (LIT). The precursor ion or the fragment ion of a particular mass to charge ratio (m/z) can then be isolated in the collision cell or LIT 28 by a number of methods, such as resonant ejection of all other ions, application of RF and DC voltages to the LIT to isolate an ion at the tip of a stability region, or ejection of ions with an m/z lower than that of the selected ion by increasing the RF voltage or other known means.

After isolation the selected ion can then be excited by resonant excitation or other means to produce fragments of the selected, fragment ions; thus the original ions from source 12 are dissociated to produce fragment ions, and a selected fragment ion can be further fragmented to produce fragments of fragment ions.

The blocking potential at the exit 33 of the collision cell 28 can then be lowered to transfer the ions to the third quadrupole Q3. When ions are being transferred to the third quadrupole, a stopping potential is applied to the entrance plate 32. Quadrupole Q3 is operated, with suitable RF and DC voltages, to record a spectrum at the detector 36. It will be appreciated that the trapping isolation and fragmentation cycle can be repeated more than once, to provide $MS^n$ capabilities.

Figure 2A:
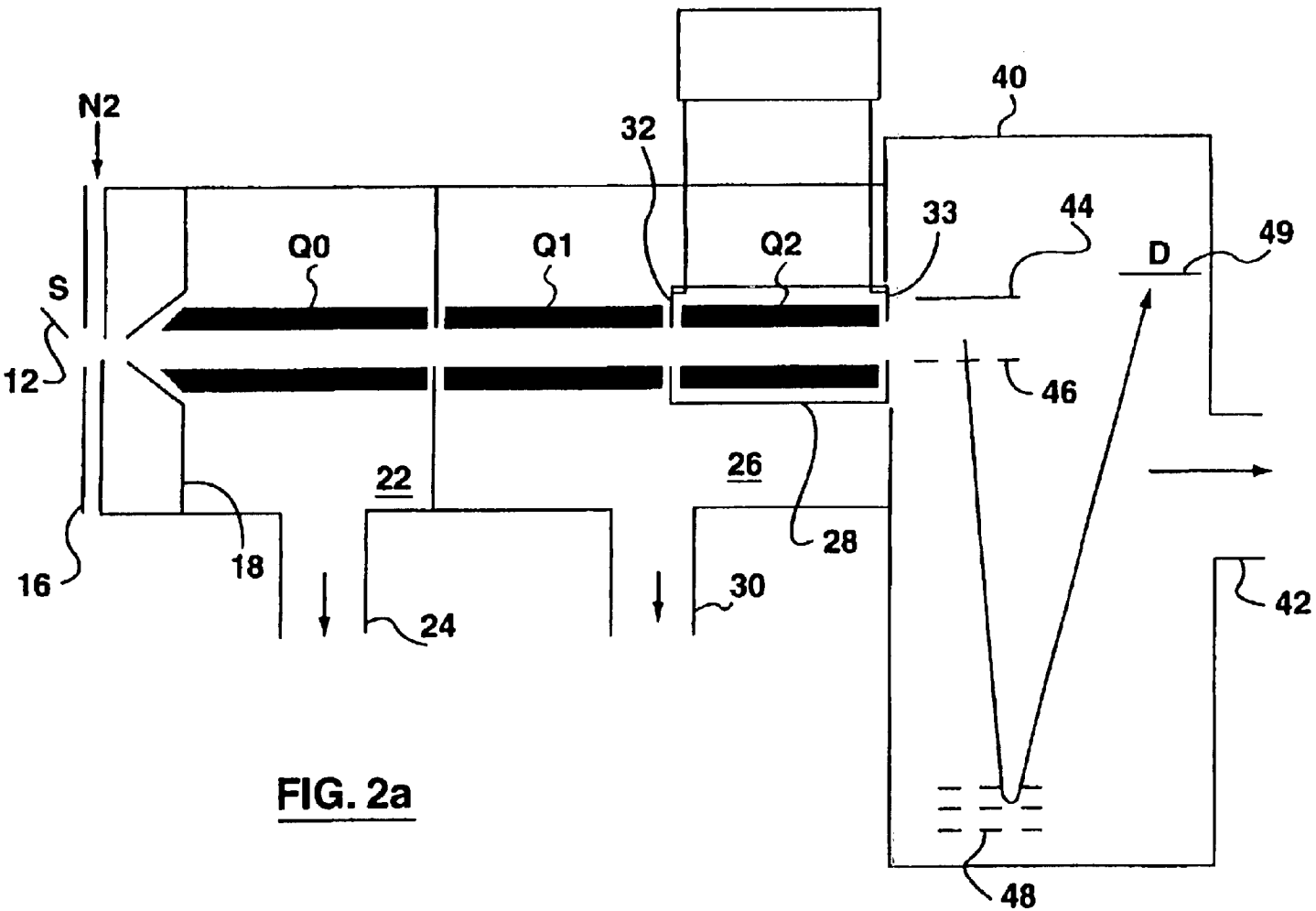
FIG. 2*a* is a schematic diagram of a mass spectrometer including a TOF in accordance with the second embodiment of the present invention.

Reference will now be made to FIG. 2*a*, which shows an apparatus similar to FIG. 1 but with the third quadrupole Q3 replaced by a time of flight instrument, indicated at 40. Otherwise, for simplicity and brevity, like components in FIG. 2*a* are given the same reference numeral as in FIG. 1, and description of these components is not repeated.

Figure 2B:
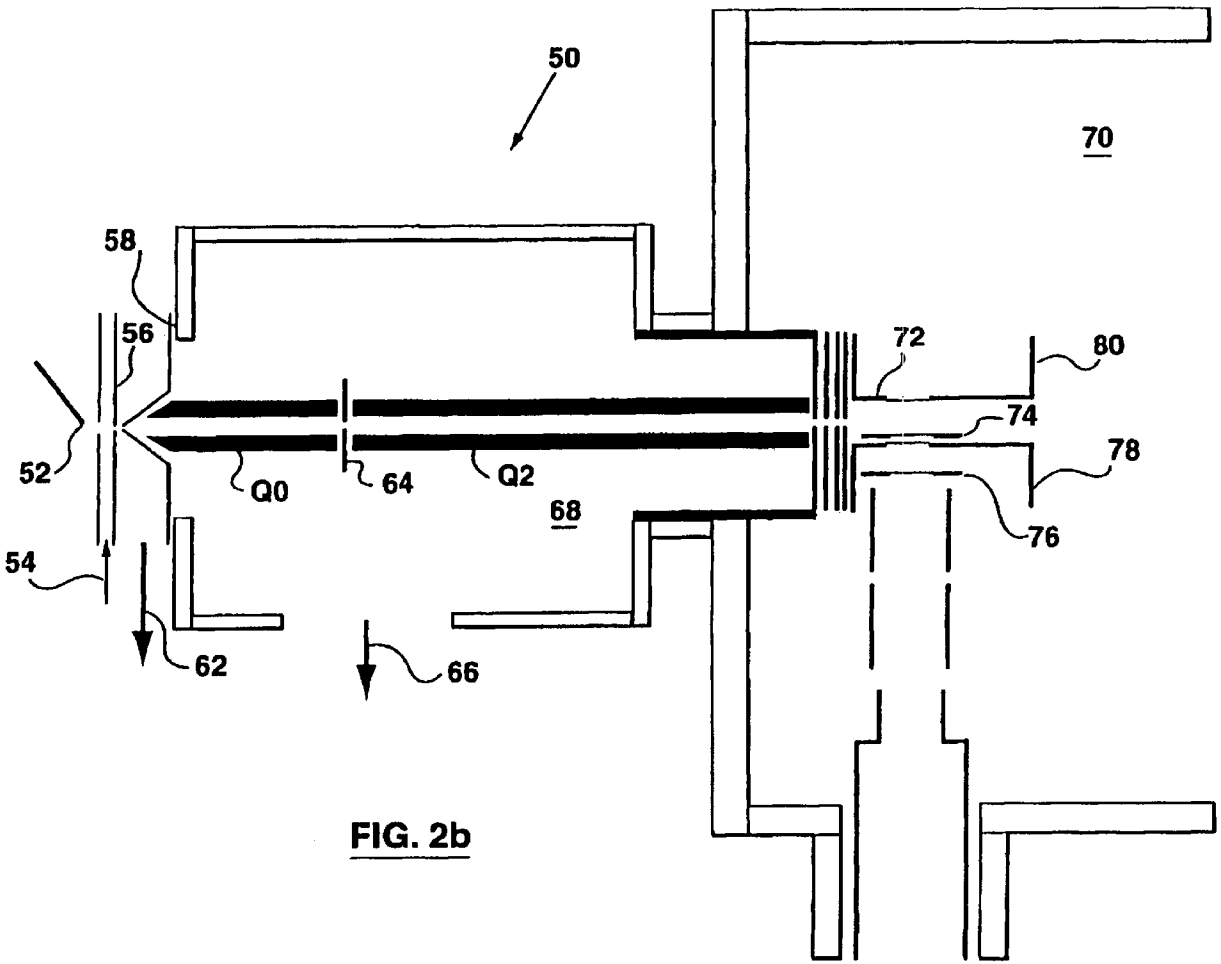
FIG. 2*b* is a schematic diagram of a mass spectrometer including a TOF, according to a third embodiment of the present invention and similar to FIG. 2*a*, but without a first mass resolving quadrupole.

In FIG. 2*a*, the time of flight device 40 is connected to the exit plate 33 of the collision cell 28. In known manner, the time of flight device 40 includes a connection 42 to a pump for maintaining a vacuum at $5\times10^{-7}$ torr ($6.5\times10^{8}$ kPa). It includes a repeller grid 44 and other grids indicated schematically at 46, for collecting ions entering the TOF 40 and transmitting a pulse of ions. The TOF device 40 here is a reflectron and includes grids 48 for reflecting the ion beam, which is then detected by a detector 49. A linear TOF may also be used, as shown in FIG. 2*b*.

The apparatus in FIG. 2*a* would be operated in an essentially similar manner to that of FIG. 1. The principal difference is that the TOF can record $10^4$ or more complete mass spectra in one second. Thus for applications where a complete mass spectrum of fragment ions is desired the duty cycle is greatly improved with a TOF mass analyzer 40 and spectra can be acquired more quickly. Alternatively, for a given measurement time, spectra can be acquired on a smaller amount of sample.

While three-dimensional (ND) traps (IT) have been provided in spectrometers including a TOF final stage, a two-dimensional (2-D) trap has several advantages over the 3-D trap. Firstly, because there is no quadrupolar electric field in the z direction, the ion injection and extraction efficiencies can be nearly 100%. As fewer ions are lost in the processes of filling and emptying the trap the sensitivity of the Linear Ion Trap Time Of Flight Mass Spectrometer (LIT/TOFMS) can be greater than that of the IT/TOFMS (an ESI source, a 3-D ion trap mass spectrometer and a TOFMS).

Because of the increased trapping volume of the LIT, a greater number of ions ($N_{2\text{-}d}$) can be trapped in a LIT than in a 3-D trap ($N_{3\text{-}d}$). The increase in ion capacity is given by $$\frac{N_{2-d}}{N_{3-d}} = \frac{r_0^2 l}{z_0^3} \tag{1}$$

where l is the length of the LIT, $r_0$ is the field radius of the LIT, and $z_0$ is the z direction field radius of the 3-D ion trap mass spectrometer. For example, given that, in the apparatus described below, l is 20 cm, $r_0$ is 0.4 cm, and a typical $z_0$ for a commercial trap is 0.707 cm, the linear ion trap of the present invention has almost an order of magnitude increase in ion capacity. The higher ion capacity increases the concentration linear dynamic range of the LIT/TOFMS relative to the IT/TOFMS.

In addition to providing a greater trapping volume, the LIT can be operated in all of the modes for mass isolation and MS/MS of a 3-D ITMS. Ion motion in the RF quadrupole fields of both the quadrupole rod set and the quadrupole ITMS geometry are identical and described mathematically by the solutions to the Mathieu equation. Ion motion is decoupled in each coordinate, u, of the quadrupole field x and y in the RF only quadrupole and the x y plane and z in the 3-D ITMS. Parameters for which motion is stable in each coordinate are determined by the Mathieu parameter, $q_u$, $$q_u = \frac{4V_{rf}}{\frac{m}{z}\Omega^2 u_0^2} \tag{2}$$

where $V_{rf}$ is the applied RF voltage from an electrode to ground (0 to peak), $$\frac{m}{z}$$

is the mass-to-charge ratio of the ion, $u_0$ is the field radius of the device for that coordinate, and Ω is the angular frequency of the trapping RF drive. In the commonly used first stability region, ions for which $0 \leqq q_u \leqq 0.9$ have stable trajectories in the quadrupole device. Thus, if $V_{rf}$ and Ω are fixed there is a lower limit to the $$\frac{m}{z}$$

of ions which have stable trajectories in the trap.

The frequencies of ion motion are given by $$\omega_n = (2n + \beta)\frac{\Omega}{2} \tag{3}$$

where n is an integer, $-\infty<n<\infty$, and $\beta$ is a function of $q_u$. If $\beta \leqq 0.4$, ($q_{x,y} \leqq 0.6$ in an RF only quadrupole) then the adiabatic approximation is valid and ion motion in the quadrupole field is like that of a charged particle moving in a harmonic "pseudopotential" well of depth $$D_u = \frac{q_u}{8} V_{rf} \tag{4}$$

Each $$\frac{m}{z}$$

thus has a unique fundamental resonant frequency $\omega_0$ (n=0 in equation (3)), given approximately by $$\omega_0 = \frac{q_u}{\sqrt{8}}\Omega \tag{5}$$

The motion of the ion in the LIT can be excited through the application of an auxiliary voltage on one set of pole pairs in the x or y direction. This oscillating voltage, $V_0$, has the form $$V_a = A_a \sin \omega_a t$$

where $A_a$ and $\omega_a$ are the amplitude and frequency of the auxiliary voltage, and t time. Application of the auxiliary voltage at the resonant frequency of an ion causes the amplitude of its oscillation to increase linearly with time. If the amplitude exceeds $r_0$ (or equivalently, energy increase from resonant absorption is greater than $D_u$) the ion will be ejected from the trap. In the presence of a background neutral gas, the excited ion motion will result in an increase in the number and energy of collisions. As kinetic energy is transferred to ion internal energy, the ion may reach its critical energy for collision induced dissociation (CID) and fragment.

Reference will now be made to FIG. 2*b*, which shows an alternative embodiment. This was designed without the initial, mass resolving quadrupole Q1, to provide experimental data on the performance of the LIT. It also includes a linear TOF section, to provide LIT/TOFMS.

The LIT/TOFMS was designed to be flexible with three modes of operation: (i) continuous flow-TOFMS, in which the products of ESI can be analyzed without trapping or fragmentation; (ii) trap-TOFMS, in which the combination of trapping and pulsing ions can be used to enhance instrumental duty cycle; and (iii) MS/MS-TOFMS in which the fragmentation spectra for isolated precursor ions are recorded via TOFMS. Switching between modes is a simple matter of changing the parameters which control timing, trap entrance and exit potentials, and excitation frequencies and amplitudes.

In FIG. 2*b*, the spectrometer is indicated generally at 50. Ions are generated by pneumatically assisted electrospray at 52 and pass through a dry nitrogen curtain gas 54, a 0.25 mm diameter sampling orifice in an orifice plate 56, a 0.75 mm diameter orifice in the skimmer 58, and into a first RF-only quadrupole Q0. The region between the skimmer and the orifice is evacuated by a rotary vane pump as indicated at 62, to a pressure of 2 torr (0.3 kPa). A second quadrupole rod set is indicated at Q2. For consistency with FIG. 2*a*, the designation Q2 is used, although there is no Q1 in FIG. 2*b*.

The RF-only quadrupoles Q0, Q2 are separated by a 1 mm diameter interquad aperture 64 (IQ). The first quadrupole, Q0, is 5 cm long and the second Q2, which acts as the LIT, is 20 cm long. Both quadrupoles have field radii of 4.0 mm and are operated by the same main RF drive, which has a maximum $V_{rf}$ of 5000 V and a drive frequency, $\Omega=2\pi f$ where f is 1 MHz. There are 12.5 pF capacitors between the RF drive supply and the rods of Q0; thus the RF voltage on Q0 is ca. one half that of Q2. The DC offsets of the quadrupoles are individually set and for all the experiments here these are Q0=10 V and Q2=0 V. The pressure in the LIT can be varied from 1.5 to 7.0 mTorr ($2\times10^{-4}$ to $9.1\times10^{-4}$ kPa) by adding gas. The region surrounding the LIT provided by Q2 is connected to a turbomolecular pump, as indicated at 66. The LIT chamber is indicated at 68.

A TOF chamber 70 is coupled orthogonally to the LIT chamber 68 via four lenses, L1–L4. L1 (aperture diameter 0.75 mm) serves as the exit of the LIT chamber 68 and the differential pumping aperture between the LIT and the TOF chambers. The three lenses, L2, L3 and L4, have apertures of 2 mm diameter and are used to focus the ion beam into the source region of a two stage, 1 m long, TOFMS. The TOF chamber 70 is held at a pressure of $1.2\times10^{-6}$ torr ($1.6\times10^{-7}$ kPa) or less by a turbomolecular pump. Separate rotary vane pumps are used to pump the region between the orifice and skimmer and to back the turbo pumps.

In the TOF source region, in known manner there are a repeller grid 72, a middle TOF grid 74 and a final TOF grid 76. The ion source was operated near ground potential and the flight tube was floated at a negative high potential, typically 2.0 kV. To reduce distorting effects of the floating voltage a shielding grid 78 was placed 4.2 mm behind the middle TOF grid 74. An additional shielding grid 80 was placed around the repeller grid 72 and the middle TOF grid to reduce the effects of stray fields on ions entering the source region. Ions are accelerated in the TOF in a direction orthogonal to that of the quadrupoles. Thus, the system is termed an orthogonal acceleration TOF (oa-TOF).

There is no potential difference between the Q2 offset and the source region, thus the axial ion energy in the TOF source is <1 eV. The repeller grid 72 of the TOF is pulsed from an offset of 0 V to an amplitude of 200–300 V using a high voltage (HV) pulser (rise time<18 ns). The amplitude of the HV pulse is adjusted to achieve maximum resolution for the ion acceleration energy. Because the ions enter the source region midway between the repeller grid 72 and grid 74, the acceleration energy is given by one half of the amplitude of the HV pulse minus the negative float potential. The experimental HV pulse amplitudes that gave the best resolution were found to equal those calculated to give space focussing for the set acceleration energies. The HV pulse width is set to be greater than
the time for the ions with the highest $$\frac{m}{z}$$

to exit the TOF acceleration region. This width is much less than the flight time which defines the TOFMS scanning rate, typically 10 $\mu$s and 100 $\mu$s respectively. After the HV pulse is complete and during the ion flight time, the repeller plate 72 voltage is set to a potential which allows for ion transmission into the source region. The duty cycle of the oa-TOFMS is thus given by the ratio of the source filling time to the time between the pulses to the repeller plate 72. Because this duty cycle is increased if the ions move more slowly through the source region it is preferable that the coupling of the LIT to the TOFMS incorporate a method to ensure low energy ions enter the source.

Duty cycle, resolution, and sensitivity are all increased through the combination of the orthogonal acceleration coupling geometry with collisional cooling in RF-only quadrupoles operated at relatively high pressures. In the z direction of the quadrupole, dampening of translational energy creates a slower, higher ion density beam. In addition to increasing the duty cycle, a slower beam gives a higher ion density to each pulse accelerated into the flight tube, thus enhancing sensitivity. Energy dampening in the x, y direction also occurs, causing the ions to move to the center of the quadrupole rods. The resultant beam has a small spatial and energy spread in the radial direction, which improves resolution in the TOFMS.

For these benefits from collisional cooling to be realized, it is necessary to minimize any defocusing of the beam as it travels from the LIT to the source region of the TOFMS. In particular, any stray fields from the float potential which penetrate into the source region will cause broadening or deflection of the ion beam, thereby degrading resolution. For this reason, the various shielding grids 78, 80 are provided.

For the study of biomolecules, which often have large collision cross sections, the flight tube must have a pressure which is low enough for the mean free paths ($\lambda$) of the ions to be longer than the flight tube. Otherwise collisions between ions and residual gas result in a substantial loss in resolution in the TOFMS. Nitrogen was added to the flight tube to increase the pressure over the range $1.2\times10^{-6}$ torr ($1.6\times10^{-7}$ kPa) to $5\times10^{-5}$ torr ($6.5\times10^{-6}$ kPa), corresponding to a decrease in the mean free path for the +13 charge state of cytochrome c (collision cross section ~1700 Å$^2$) from ~106 cm to ~4 cm. The resolution in the TOFMS spectrum degraded from 600 to 30 with a ca. 25×increase in the number of collisions. At $1.2\times10^{-6}$ torr ($1.6\times10^{-7}$ kPa), the probability of the ion undergoing zero collisions in the flight path is 52% and of one collision 34%. Extrapolation of a graph of resolution vs. $\lambda^{-1}$ shows that at zero pressure the resolution is improved ca. 6% over that of $1.2\times10^{-6}$ torr ($1.6\times10^{-7}$ kPa).

Figure 3:
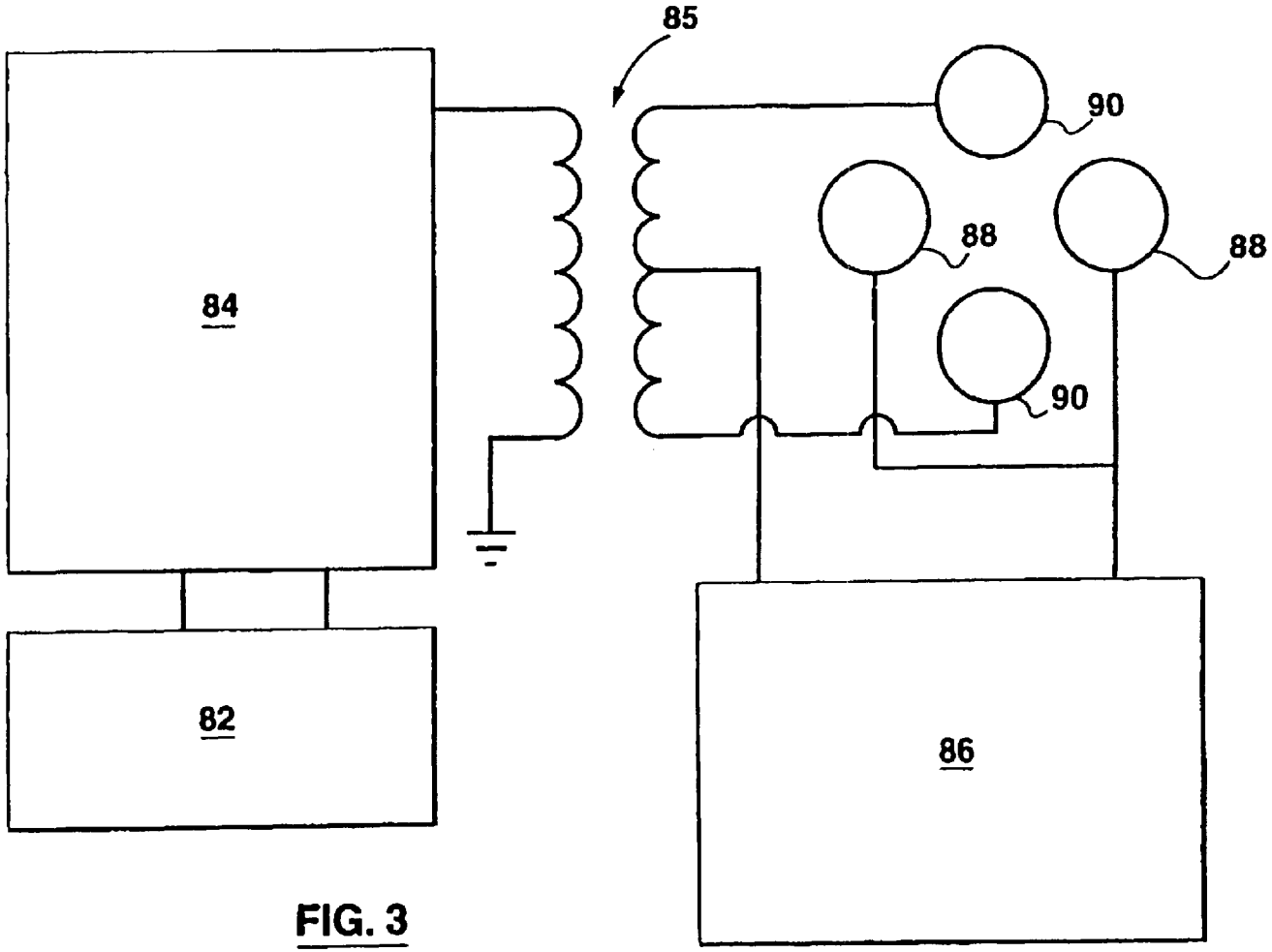
FIG. 3 is a schematic diagram showing coupling of an auxiliary drive to quadrupole rods.

A schematic of the RF operation for the LIT is shown in FIG. 3. The master clock for the LIT/TOFMS is provided by a two channel arbitrary waveform generator 82 (AWG). Each channel of the AWG 82 provides a maximum amplitude (0 to peak) of 12 V. The AWG 82 is connected to an auxiliary drive (Aux. Drive) 84, which in turn is connected by a bipolar transformer 85 to the y rods. A main RF drive 86, as shown, is connected directly to the x rods, with one connection being through the transformer 85 to the y rods.

Figure 4:
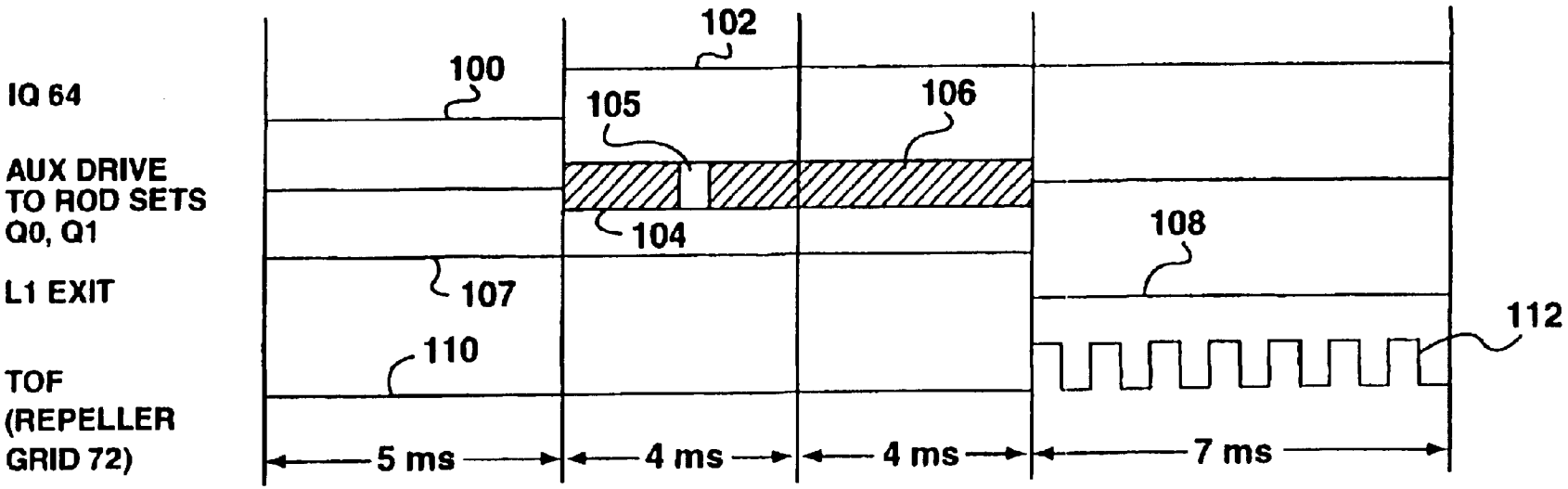
FIG. 4 is a diagram showing variation of voltages in various elements of the spectrometer of FIG. 2 over a cycle.

As shown in FIG. 4 the complete MS/MS cycle takes 20 ms to complete. It involves changing the potentials on the interquad aperture (IQ) 64 and exit aperture L1, control of the auxiliary driver 84 which connects the output of the AWG 82 to the quadrupole rods Q2, and the TOFMS pulsing (TOF).

The first phase of the cycle is ion injection. A synchronization pulse from the AWG 82 triggers a pulse generator (not shown) which controls the potential on IQ 64, which is maintained at a potential (~7 V) indicated at 100 to pass ions for a set injection time (typically 5 ms as shown in FIG. 4) and a stopping potential 102 (12 V) for the remaining 15 ms of the scan. In addition this injection time serves as a thermalization period. For the ions that were studied, fragmentation spectra were independent of orifice skimmer potential difference, suggesting that any ion heating in the ion sampling region has equilibrated during the injection period.

The injection period is followed by a trapping period, typically 8 ms, in which the precursor ion isolation and excitation are completed. The superposition of the auxiliary voltage on the main RF-drive is shown at 104 in FIG. 4.

The second channel of the AWG 82 was used to generate auxiliary excitation waveforms. This output was connected to the Aux. Drive 84 and to the primary of the bipolar transformer through an additional transformer (not shown) with a 2.5:1 step up voltage ratio to give 0–30 V peak amplitudes at the RF rods. Dipolar excitation is applied only in the y direction. In the first quadrupole, Q0, output from the main RF-drive is connected directly from the x and y outputs of the RF drive; resonant excitation is applied only to Q2 and not to Q0.

Parent ion isolation is accomplished through the use of a notched broadband excitation waveform which is applied for 4 ms. The broadband excitation waveform spans frequencies from 10 kHz to 500 kHz, and is created by a "comb" of sine waves, each with an amplitude of 30 V and separated by a frequency of 500 Hz. A typical notch in the broadband waveform is 2–10 kHz wide and centered on the resonant frequency corresponding to the ion of interest. This is indicated schematically at 105 in FIG. 4, but it will be appreciated that this notch is in the frequency domain and not in time.

Resonant excitation for MS/MS is accomplished by varying the frequency of a sinusoidal wave in the software provided with the arbitrary waveform generator. The amplitude was varied from 0 to 30 V and the duration time from 1 to 40 ms. This is indicated schematically at 106.

For the trapping period both IQ 64 and L1 are held at stopping potentials (12 V) as shown at 102 and 107, with the stopping potential being applied to IQ 64 after the injection period. It has been shown previously and was experimentally verified for this system, that the LIT has a near 100% trapping efficiency for periods of at least up to 200 ms. All data were recorded with trapping times much less than 200 ms so there is no need to consider trapping losses.

The last phase of the MS/MS cycle is the detection of fragment ions. As shown in FIG. 4, L1, which is controlled by channel 1 of the AWG, is held at a stopping potential 107 (+12) for the first 13 ms of the MS/MS scan and at a potential 108 (−10V) to transmit ions for a set trap emptying time, typically 7 ms. In addition, channel one of the AWG 82 gates a pulse generator (not shown) which is used to trigger the TOF HV pulsing and the detection electronics. Thus, only when the trap is being emptied are TOF scans acquired. As indicated at 110, the TOF repeller grid 72 is turned off during the front 13 ms of the cycle and during a trap empty period of 7 ms is excited at the scanning rate of 10 kHz as indicated at 112. As the TOF scanning rate is typically 10 kHz, there are 70 TOF scans for each empty cycle. The time to fill the source region is typically 10 its giving an MS/MS duty cycle determined from separate TOF and quadrupole duty cycles as follows:

TOF duty cycle:

$$\frac{\text{number of TOF scans} \times \text{time to fill TOF source region}}{\text{time for whole cycle}} \times 100\% = \frac{70 \times 0.01}{20} = 4\%$$

quadrupole duty cycle:

$$\frac{\text{injection time}}{\text{time for whole cycle}} \times 100 = 25\%$$

25%×4%=1%

The following materials were used in the tests detailed below:

Reserpine, renin substrate tetradecapeptide, and cytochrome c (from horse heart) from Sigma (St. Louis Mo., U.S.A.). Unless otherwise noted, solutions were as follows: reserpine (MW=608), 1 μM in acetronitrile (HPLC grade, Fisher Scientific, Nepean, Ont. Canada); renin substrate (mw=1759), 5 μM in 85:10 water:methanol with 5% acetic acid (HPLC grade, Fisher Scientific, Nepean, Ont. Canada); and cytochrome c (mw=12300) 5 μM in 50:50 water:methanol with 5% acetic acid. The solution flow rate for all experiments was 1 μL/min. Gases were from Praxair, (Vancouver, B.C., Canada) with manufacturer's stated purities of 99.999% ($N_2$, UHP grade) and 99.995% (Kr, UHP grade).

The use of the LIT to enhance the duty cycle of the TOFMS was demonstrated with a storage experiment using ions of cytochrome c. In this experiment, IQ 64 is always set to pass ions. L1 is held at stopping potential for varying lengths of time. The time between the lowering of the potential on L1 and the scanning of the TOFMS is varied to determine the time for the densest portion of the trapped beam to reach the accelerating region. There was a single TOF scan for each trapping period.

On average the delay required between lowering L1 and the TOF scanning was 60 μs and the TOF accelerating pulse width was 10 μs. When operated in continuous flowing conditions the TOFMS 50 had an intensity of 2.2 ion counts per pulse. If a stopping potential is applied to L1 for the last 40 μs of the 100 μs flight time, ion counts per pulse were found to triple to 6.6. In effect, this prevents premature entry and subsequent loss of ions in the source region between grids 72, 74; instead, the ions are trapped in Q2, enabling the total number of ions to build up, leading to an increased number of ions per pulse. It is important to note that this sensitivity enhancement occurs without any sacrifice in TOFMS scanning time. Similarly, if the repitition rate is decreased to 5 kHz that is the time between TOF MS pulses is increased to 200 As and the stopping potential applied to L1 for the last 100 μs of the flight scan, the ion intensity increased to 8.5 ions per pulse, which is almost double the 4.4 ions which would be detected in the same time period were no trapping used. Using trapping to create a denser, low energy beam gives overall higher sensitivity than co-adding with continuous flowing conditions.

Furthermore, the increase in trapping time is accompanied by a parallel increase in the extent of collisional cooling. Thus the trapped beam has a further decrease in spatial and energy spread in the radial direction. This renders a further improvement in resolution in the TOFMS if trapping times are sufficiently long. For instance, a trapping time of 1 ms improves TOFMS resolution by 10%.

Figures 5A, 5B:
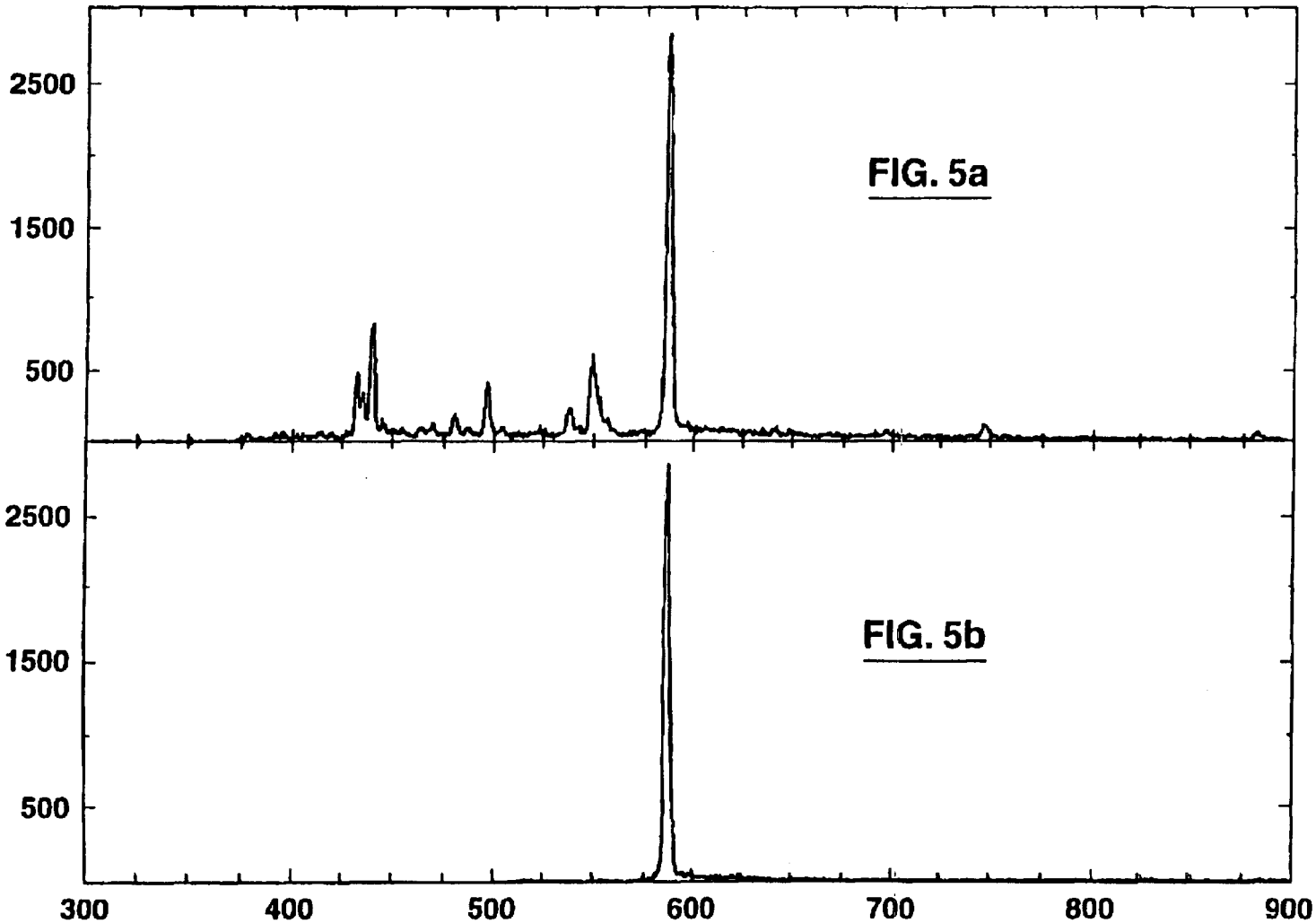
FIGS. 5*a* and 5*b* show spectra from a solution of renin substrate, showing isolation of a selected charge state.

FIGS. 5*a* and 5*b* show the spectra from a solution of 5.0 μM renin substrate before and after the application of a 4 ms broadband excitation waveform with a notch designed to isolate the +3 charge state of renin substrate $$\left(\frac{m}{z} = 587\right)$$

at q~0.600. The notch spanned 211 kHz to 217 kHz and $\omega_0$ for the precursor ion was calculated from equation (5) to be 212 kHz, which gives a nominal ejection "resolution" of 100.

Although the concept of using resonant excitation in RF-only quadrupoles in the presence of a neutral gas has been demonstrated previously, by Dodonov et al and Loboda et al, as noted above, the present invention provides for the isolation and trapping of ions in a LIT. The following test results provide a systematic study of CID in a LIT.

The resonant frequency of an ion can be calculated from equation (5) to an accuracy of 1%, provided that $q_u$ is less than 0.6. Any difference between the calculated and experimental resonant frequencies could be indicative of the presence of higher order electric fields or perturbations from space charge effects. In the parameters for CID here no substantial shifts between calculated and experimental resonant frequencies were observed.

Figure 6:
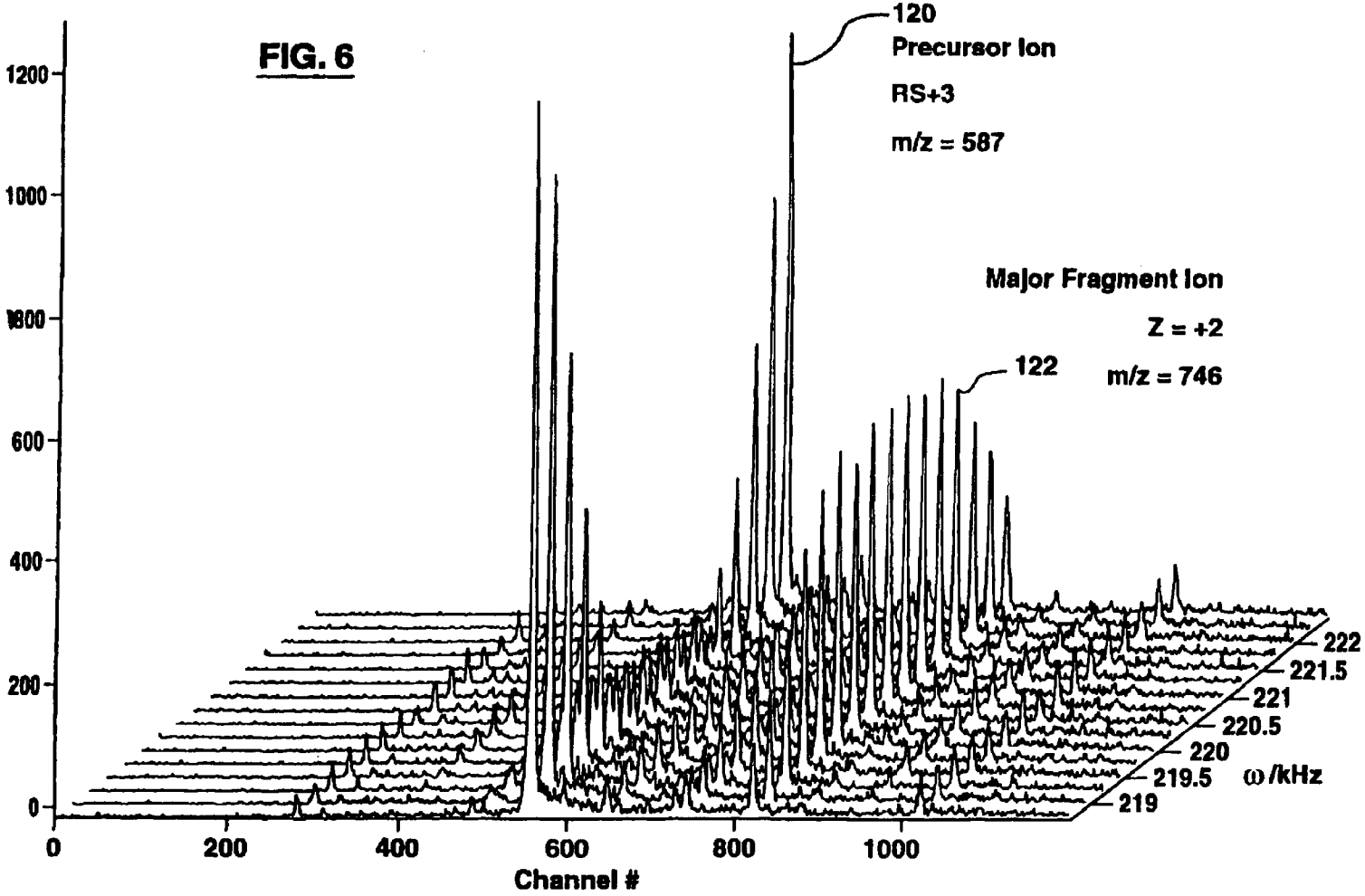
FIG. 6 is an isometric 3 dimensional view showing variation of ion intensity with channel number and excitation frequency.

FIG. 6 shows the raw data for an MS/MS experiment which demonstrates the variation in the recorded spectra of renin substrate as the frequency of the auxiliary voltage is varied. The spectra are plotted in channel numbers, where each channel is 20 ns wide and channel 0 represents a flight time of 30 μs. FIG. 6 shows the variation of intensity with both channel # and frequency of auxiliary voltage applied to Q2. In FIG. 6, the m/z of an ion is related to the channel number, n, by the following equation:

$$n = \sqrt[a]{\frac{m}{z}} + b,$$

where a and b are constants.

The +3 charge state $$\left(\frac{m}{z} = 587\right)$$

was isolated via application of the broadband waveform for 4 ms, and the precursor was excited for 4 ms (amplitude 1.5 V, $q_y$~0.623, $\omega_o$~220 kHz). As expected, the intensity of the precursor ion shown at 120, falls as the fundamental frequency $\omega_a=\omega_o$ of its motion is approached and rises again for $\omega_a>\omega_o$. Correspondingly, the major fragmentation, shown at 122, peaks at $\omega_a=\omega_o$. This plot is shown in more detail in FIG. 7*a* which plots the intensity of the precursor ion 120 and sum of fragment ions, indicated at 124, versus excitation frequency. The excitation width for this system is 3.0 kHz; thus the mass resolution of the excitation in this experiment is 73

$$\left(\frac{f}{\Delta f} = \frac{m}{\Delta m}\right).$$

Figure 7B:
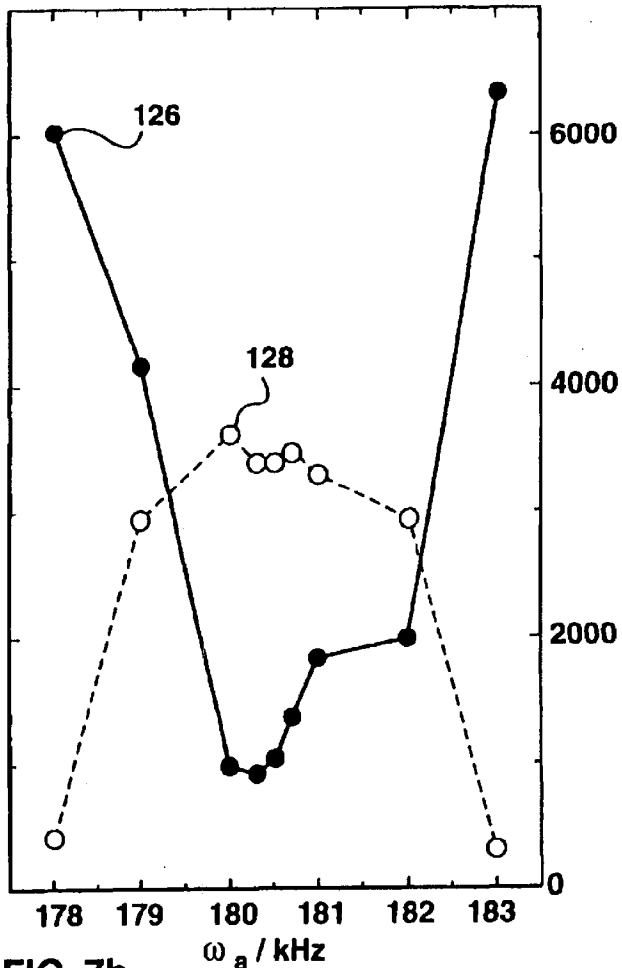
FIGS. 7*a* and 7*b* are graphs showing variation of intensity against frequency.
Figure 7A:
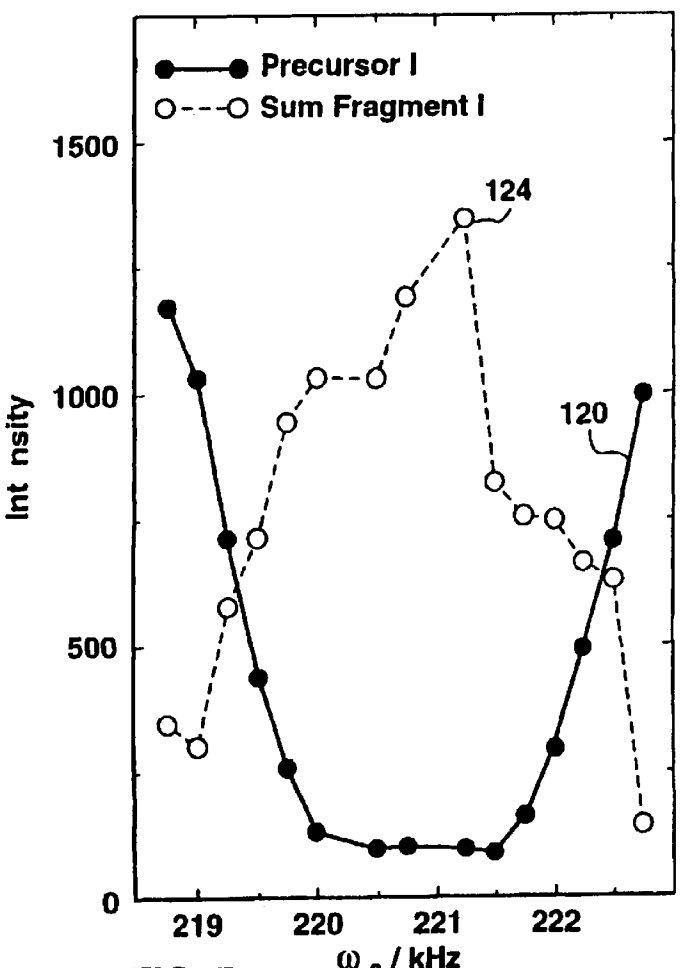

As is evident from FIGS. 6 and 7*a*, resonant excitation induces a significant degree of fragmentation but without adequate knowledge of the charge states of these fragments of renin substrate +3 it is difficult to comment on the total fragmentation efficiency of the system. FIG. 7*b* plots the precursor and fragment ion intensities at 126 and 128 respectively, as a function of frequency for the excitation of the +1 charge state of reserpine for 4 ms (amplitude 2.4 V, $q_y$ ~0.51, $\omega_o$=181 kHz). Fragmentation efficiency can be calculated from the ratio of the sum of the intensities of all fragment ions to the intensity of the precursor ion prior to the application of the excitation; for reserpine (FIG. 7*b*) it is found to be $$-\frac{3750}{6250}\times 100 = 60\%.$$

A higher excitation resolution is possible if one is willing to sacrifice fragmentation efficiency and duty cycle through the use of a lower excitation amplitude in conjunction with a longer excitation period.

Due to the relatively high $q_y$ setting used, the calculated low mass cutoffs are relatively high. For instance for the data plotted in FIG. 7*b* with $q_y$=0.5, only ions with $$\frac{m}{z} > 345$$

will have a Mathieu parameter for motion in the y direction, $q_y$, of <0.9 and thus stable trajectories in the trap. Lower mass fragments will have unstable trajectories and thus, even if formed by the resonance excitation process, cannot be detected in the TOFMS. This decreases the fragmentation efficiency, but this is an inherent feature of CID in any ion trap.

Figure 7D:
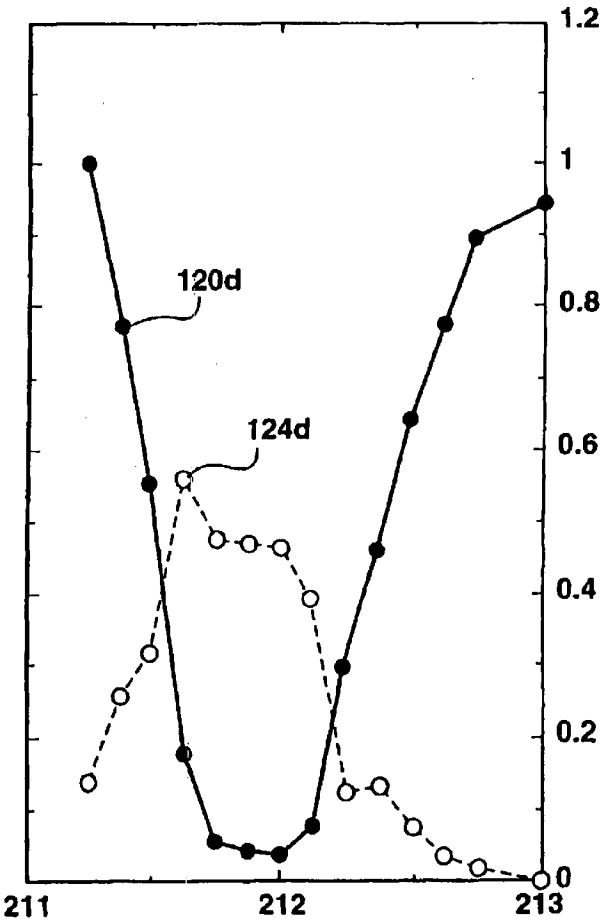
FIGS. 7*c* and 7*d* are graphs showing variation of intensity against frequency for different pressures in the chamber of FIG. 2*b;*
Figure 7C:
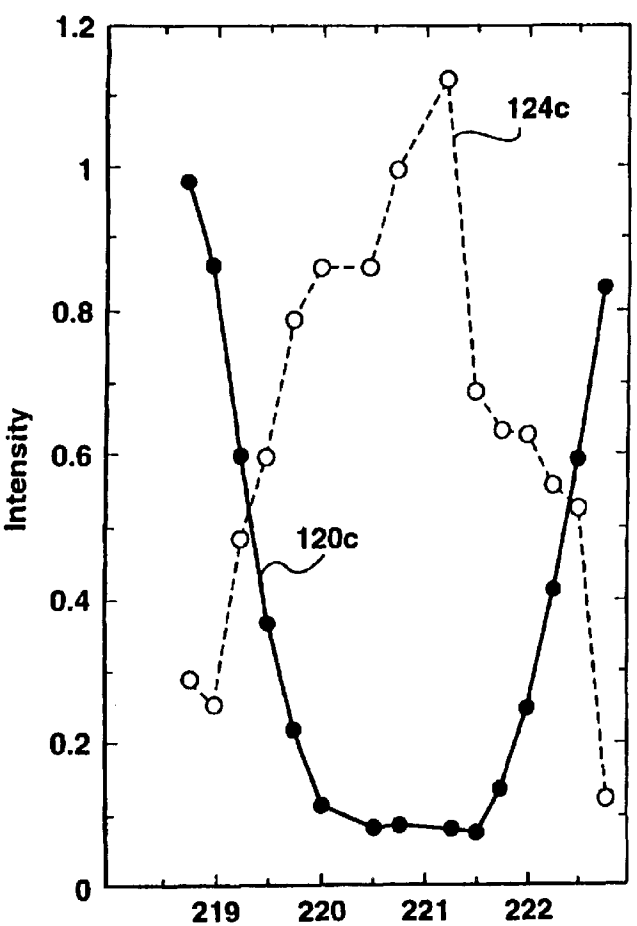

FIGS. 7*c* and 7*d* compare resonant excitation curves, which show precursor and fragment ion intensities for renin substrate as a function of the frequency, $\omega_a$ of the auxiliary voltage for $\omega_a$ near $\omega_o$ (the fundamental resonant frequency of the system) for pressures of (a) 7 mTorr ($9.1\times10^{-4}$ kPa) and (b) 1.5 mTorr ($2\times10^{-4}$ kPa) respectively in the chamber 68. The data of FIG. 7*c* is the same as FIG. 7*a*, and references 120*c*, 120*d*, 124*c*, 124*d* are used to identify the curves in these FIGS. 7*c*, 7*d*. In each case a broadband waveform constructed to isolate the precursor ion, (the +3 charge state of renin substrate $$\left(\text{the } +3 \text{ charge state of renin subtrate } \frac{m}{z} = 587\right),$$

was applied for 4 ms prior to the irradiation with the auxiliary voltage. FIG. 7*c* again shows, for a pressure of 7 mTorr ($9.1\times10^{-4}$ kPa) the intensity of the precursor ion 120*c* falling to a minimum, as the intensity of the sum of the fragments 124*c* reaches a maximum. Corresponding curves 120*d*, 124*d* are shown in FIG. 7*d*, for the precursor ions and the fragment ions for operation at a pressure of 1.5 mTorr ($2\times10^4$ kPa). The achieved resolution at 7 mTorr ($9.1\times10^{-4}$ kPa) was −70 and at 1.5 mTorr ($2\times10^{-4}$ kPa) was approximately −230. The major difference in the excitation parameters for the two pressures is the amplitude of the auxiliary voltage. At 7 mTorr ($9.1\times10^{-4}$ kPa) a 0-peak voltage of 1500 mV was required to achieve fragmentation and ejection while at 1.5 mTorr ($2\times10^{-4}$ kPa) the same phenomena were observed with 300 mV.

Figure 7E:
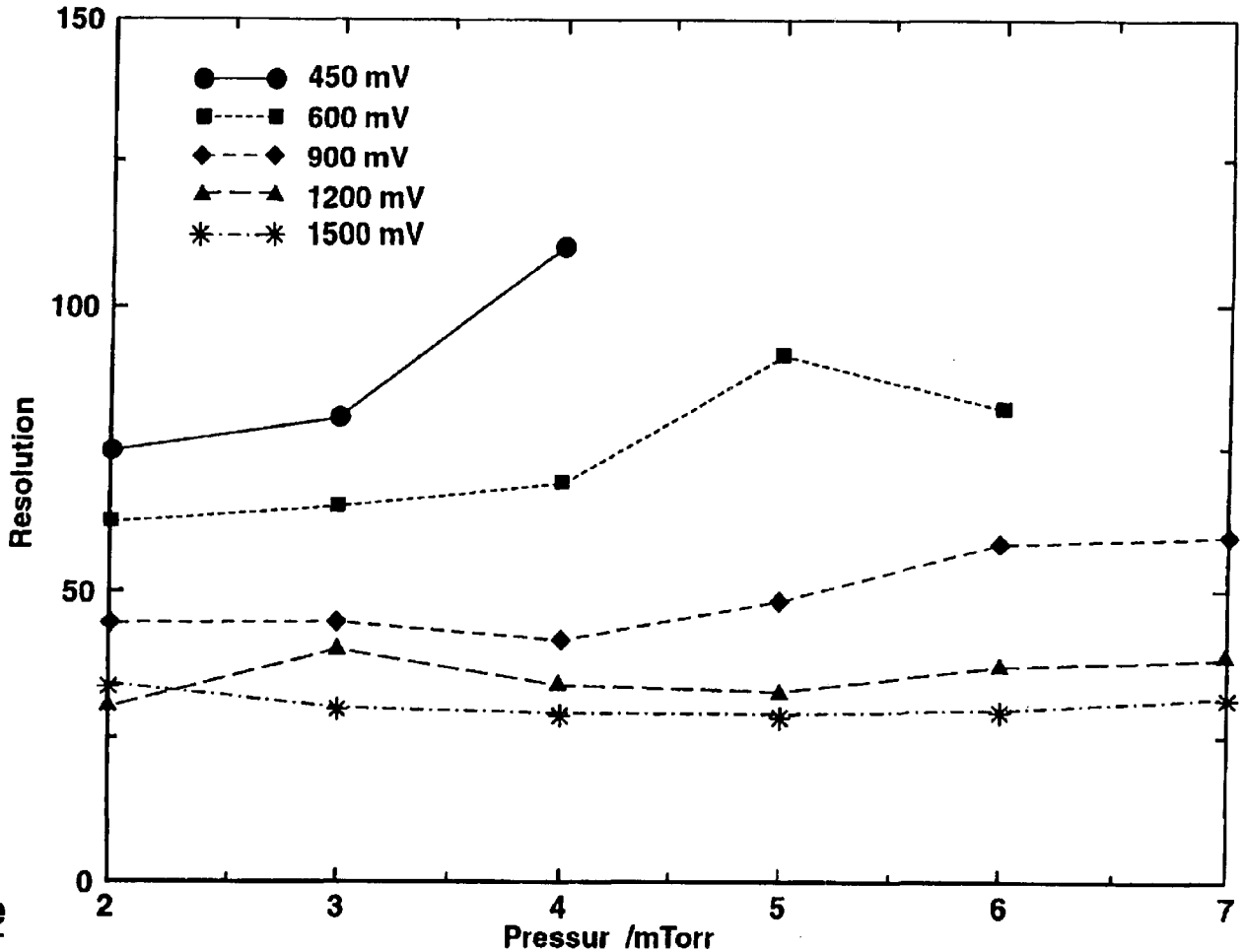
FIG. 7*e* is a graph showing variation of resolution with pressure for different excitation voltages for the apparatus of FIG. 2*b;*

FIG. 7*e* demonstrates the achieved resolutions for different excitation voltages over a range of pressures. Resolution remains essentially constant as a function of pressure at each amplitude. Clearly the use of a lower auxiliary voltage amplitude is the dominant factor in the observed improved resolution at the lower pressure.

When using resonant absorption as a technique for mass selection, achievable resolution is dependent upon the trajectories of ions for which a, is near but not equal to $\omega_o$. The amplitudes of the oscillating trajectories of ions which are irradiated with on resonant ($\omega=\omega_o$, $\Delta\omega=\omega_a-\omega_o=0$) dipolar excitation grow linearly with time. Ions which are irradiated with auxiliary voltage having a small $\Delta\omega$ have trajectories which are similar to those observed in the superposition of two travelling sinusoidal waves of nearly equal frequency. The amplitude of the fast oscillating trajectory is modulated by a slower oscillating factor, resulting in regions of high amplitude displacement and regions of low displacement—"beat" motion. If the displacement in the high amplitude portion of beat motion is larger than the field radius of the quadrupole rods, $r_0$, or if internal energy gain from collisions induced by beat motion is sufficient to cause fragmentation, these potential precursor ions will be lost and will not be detected at that $\omega$. The largest $\Delta\omega$ for which the beat motion results in precursor ion loss defines the width of the resonant excitation curve. The magnitude of the maximum displacement arising from beat motion is directly proportional to the amplitude of the auxiliary voltage and inversely proportional to $\Delta\omega$. Consequently, when larger amplitude excitation is used, ejection and fragmentation occur over a greater range of $\omega_a$ and thus the resonant excitation curve is broadened and mass resolution is degraded.

The fragmentation experiments were done with the apparatus optimized for maximum sensitivity. The mass resolution in most of the MS/MS spectra was near 300 and was independent of mass. The resolution in the TOP spectra of the precursor and fragment ions were identical within error and no significant changes in resolution as a function of excitation frequency amplitude were observed at the achieved resolutions.

Excitation of an ion in a trap leads to a competition between ion ejection and ion fragmentation. For ejection the important parameters are $q_y$, the mass and charge of the precursor ions, the pressure and mass of the collision gas, and the collision cross section of the precursor ion, as well as the duration and amplitude of the auxiliary voltage. Fragmentation, however, is also dependent upon the structure of the precursor ion, the effectiveness of the transfer of kinetic energy to internal energy through collisions, and the time scale for the unimolecular dissociation of the precursor ion. The details of this competition have been discussed for 3-D ITMS previously. There follows a discussion on tests to demonstrate how operating parameters for the apparatus of FIG. 2*b* affects competition between ejection and fragmentation.

Figure 8:
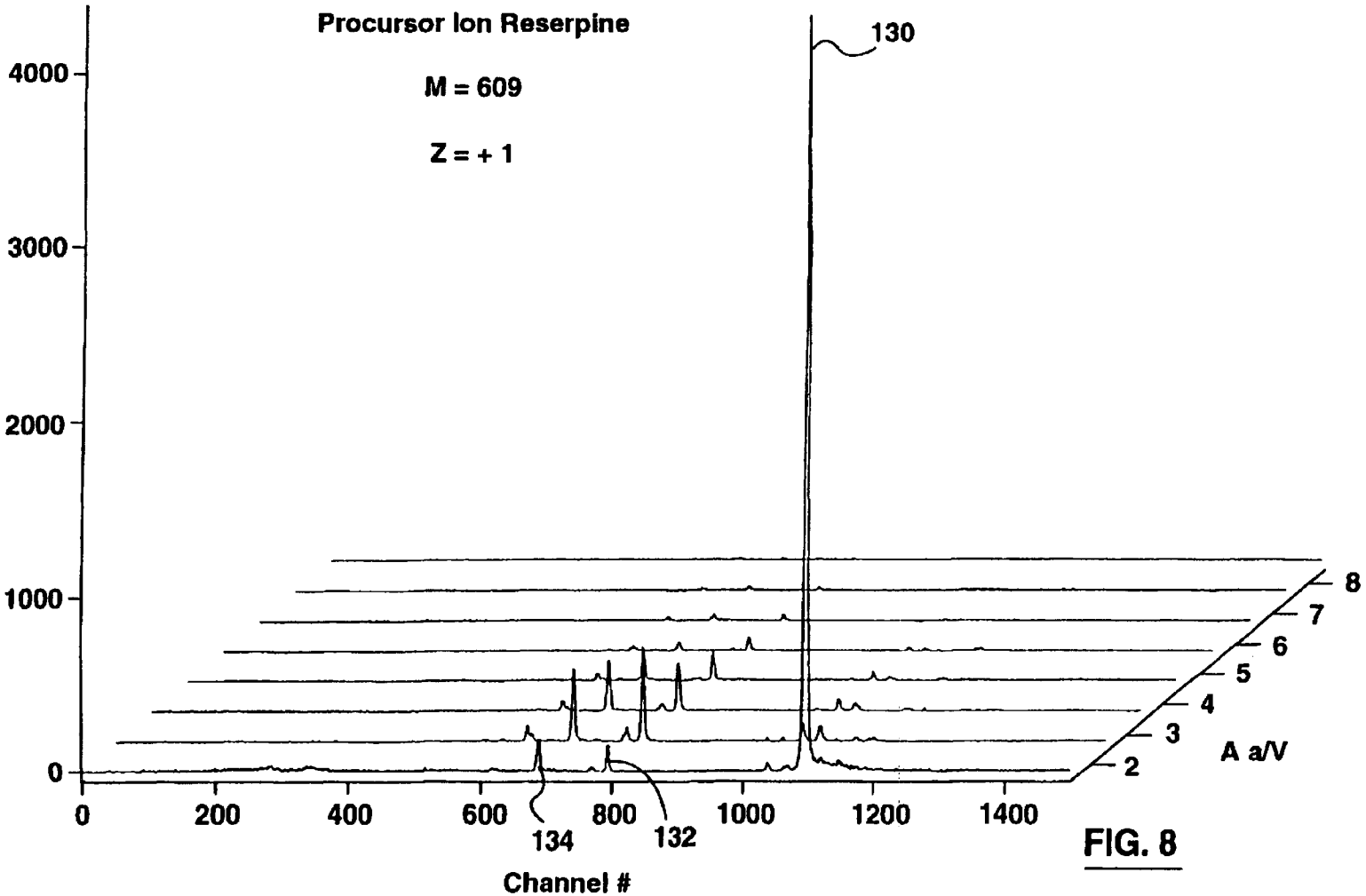
FIG. 8 is an isometric 3-dimensional view showing variation of the intensity of reserpine precursor ion with the auxiliary voltage.
Figure 9A:
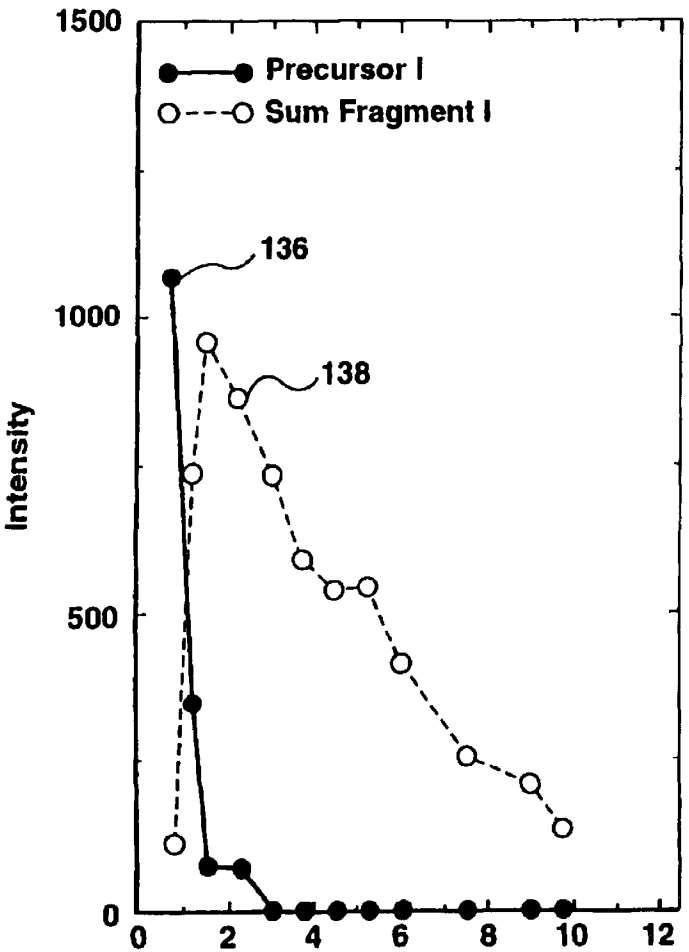
FIGS. 9*a* and 9*b* are graphs showing similar plots to FIG. 8 with the auxiliary voltage at the resonant frequency and 2–5 kHz below resonant frequency.
Figure 9B:
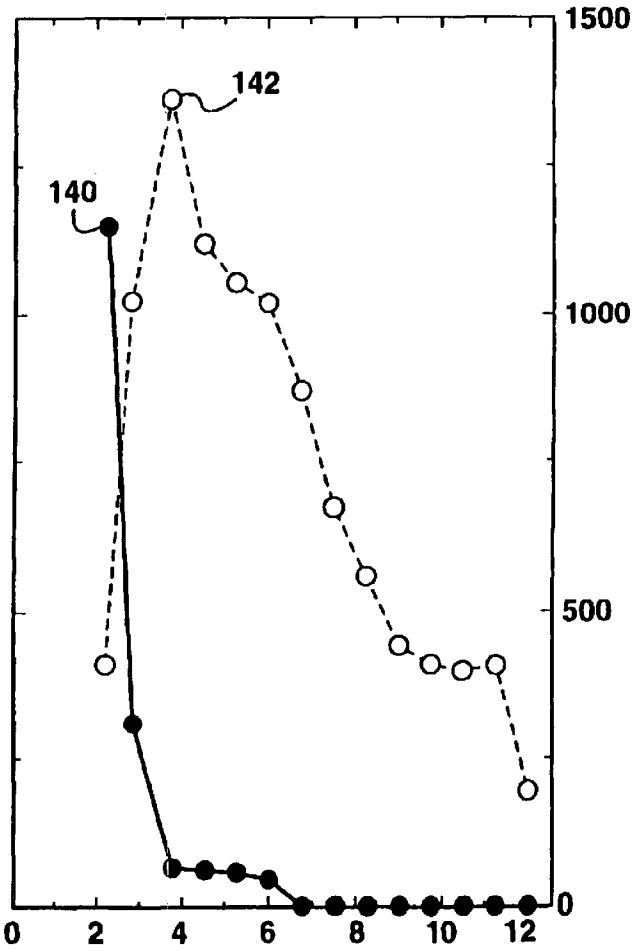

FIG. 8 shows the effect on singly charged reserpine ions of increasing the amplitude of the auxiliary voltage, as plotted against intensity and channel number. While a threshold voltage is necessary to induce fragmentation, as the amplitude increases ejection dominates and no fragmentation is observed. The precursor ion is indicated at 130, and fragments at 132, 134. FIG. 9*a* shows a similar plot for the same experiment for the +3 charge state of renin substrate, with the precursor indicated at 136 and the sum of the fragments at 138. FIG. 9*b* demonstrates the effect of increasing the amplitude of the excitation voltage at $\omega_a=\omega_o-2.5$ kHz, with the precursor indicated at 140 and the sum of the fragments at 142. The extent of fragmentation increases by 50% and the excitation amplitude for which fragmentation is one half of its maximum value increases by 40% when off resonant excitation is used. Similar increases in the extent of fragmentation and the amplitude for which fragment ions could be detected were observed for all ions and charge states examined.

The fragmentation spectrum recorded with low amplitude resonant excitation (A a=1.5 V, $\omega_a=\omega_o$) was similar to that recorded in a triple quadrupole mass spectrometer system with 15 eV laboratory injection energy and a 20 cm long collision cell filled with 1 mTorr ($1.3\times10^{-4}$ kPa) of Krypton (The triple quadrupole is described in Y-L. Chen, B. A. Collings, and D. J. Douglas, *J. Am. Soc. Mass Spectrom.* 8, 681–687 (1997)). The fragmentation spectrum recorded with high amplitude, off resonant excitation ($A_a$=6.75 V, $\omega_a=\omega_o-2.5$ kHz) was similar to that recorded with an identical triple quadrupole mass spectrometer system, but with 20 eV injection energy. Thus excitation and dissociation of ions in a LIT can produce spectra similar to those of the well established triple quadrupole MS/MS method.

Figure 10:
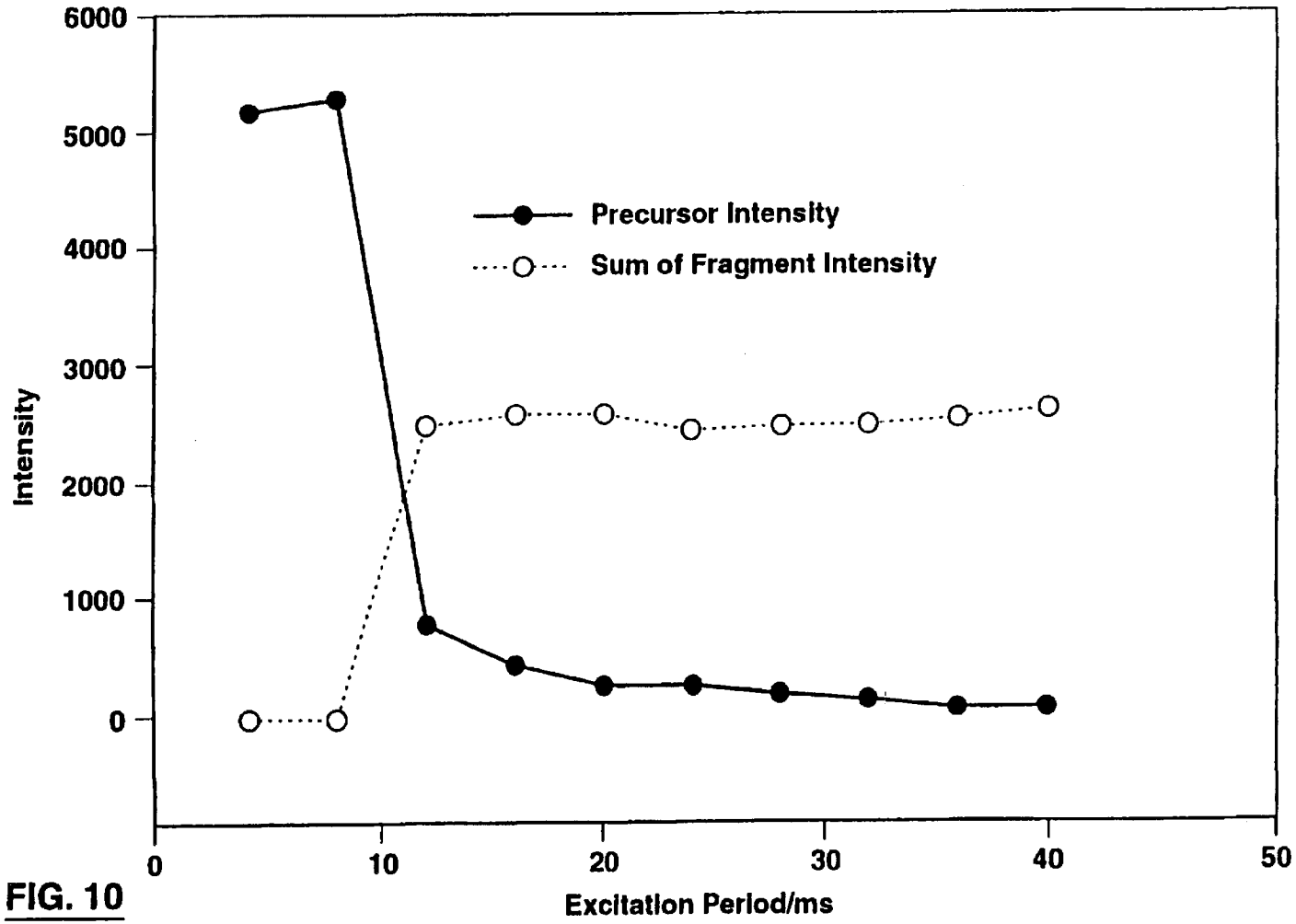
FIG. 10 shows a variation of precursor and fragment intensity with excitation period.

The effect of varying the excitation period is shown in FIG. 10. Increasing the excitation period allows for a lower amplitude for excitation. Fragmentation for a given low amplitude occurs at a threshold time and increasing the excitation time further yields no additional quantitative or qualitative spectral changes. This also demonstrates the 100% trapping efficiency of the LIT for this time frame. Note that in prior proposals, providing CID, there was no trapping, which necessarily limits the excitation period which in turn means that lower excitation amplitudes would be insufficient to induce fragmentation. Because the use of lower amplitudes gives higher resolution, the use of trapping with low amplitude excitation enables higher resolution to be obtained.

Figure 11:
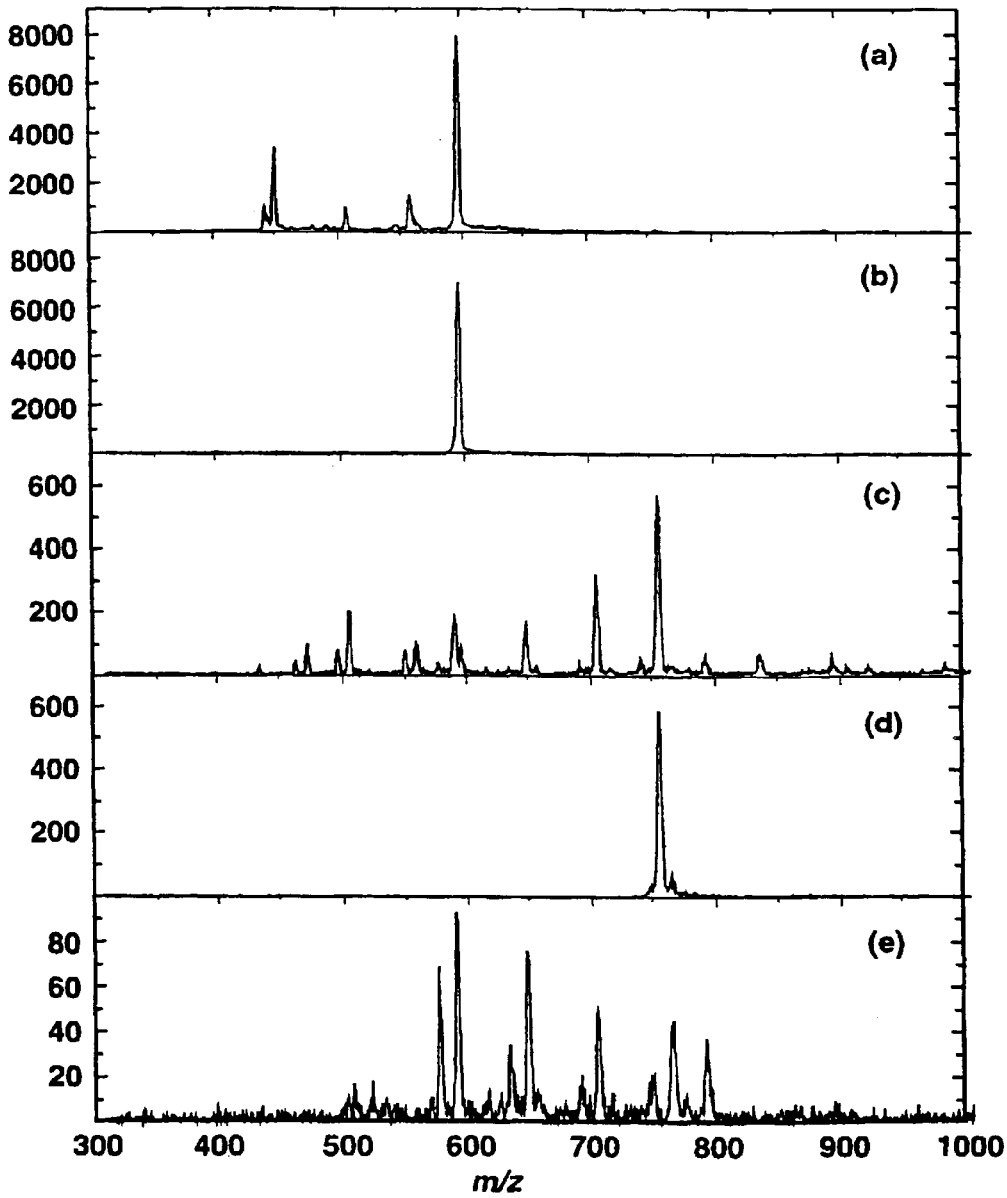
FIG. 11 is a series of graphs demonstrating $MS^3$ in the apparatus of FIG. 2*b*.

FIG. 11 demonstrates $MS^3$ in a linear ion trap, and shows a series of spectra, identified as FIGS. 11*a*–11*e*. The data was recorded on the instrument shown in FIG. 2*b*, and the $MS^3$ timing cycle was similar to that shown in FIG. 4. The products of the ESI of renin substrate, injected for 5 ms are shown in FIG. 11*a*. FIG. 11*b* demonstrates the isolation of the +3 charge state $$\left(\frac{m}{z}=587\right)$$

in Q2 via application of a broadband notched waveform for 4 ms. In FIG. 11*c* an MS/MS fragmentation pattern, similar to the plot of FIG. 6 is shown. Fragmentation was achieved through the application of a small amplitude sinusoidal oscillation for 1 ms. The next step in the $MS^3$ is the isolation of the dominant fragment, the doubly charged fragment with $$\frac{m}{z}=726.$$

FIG. 11*d* demonstrates the result of a 4 ms broadband notched waveform designed to isolate this dominant fragment, with other ions being ejected. Finally, the isolated peak is fragmented through the application of a low amplitude sinusoidal oscillation for another 1 ms. The fragments of the isolated fragment at $$\frac{m}{z}=726$$

are shown in FIG. 11*e*. The total trapping time for the $MS^3$ process was 10 ms, giving a cycle time for $MS^3$ of 22 ms, with 70 TOFMS scans in each $MS^3$ cycle. As is shown the spectral intensity is lower by a factor of 100 in the $MS^3$ process.

Nitrogen was used as the collision gas because it flowed into the quadrupole from the curtain gas region. A pressure of 7 mTorr ($9.1\times10^{-4}$ kPa) was initially used because this previously was found to give optimum collisional focussing for a single pass through an RF quadrupole of similar length. These choices however, somewhat limited the performance of the LIT. There are experimental tradeoffs when using a heavier neutral as a collision gas. The heavier neutral results in a larger center of mass collision energy for a given ion energy, and thus both a greater energy exchange in collisions and more scattering. While the larger collision energy exchange results in fragmentation occurring on a shorter time scale, the increase in the extent of scattering can degrade excitation resolution. The inelastic collisions between the gas and the precursor ion act as a "frictional force" which dampens the forced oscillation of a harmonic system and the width of the power absorption is related to the dampening of the ion motion. Lowering the pressure and mass of the gas is expected to lower the frictional force, thus narrowing the width of the power absorption and thereby increasing the possible excitation resolution. This applies to both the broadband excitation waveform and the resonant excitation resolution.

What is claimed is:

1. A method of analyzing a stream of ions, the method comprising:

(1) subjecting a stream of ions to a first mass analysis at a pressure no higher than approximately $2\times10^{-5}$ torr, to select ions having a mass-to-charge ratio in a first desired range;

(2) passing the selected ions into a radio frequency linear ion trap (Q2) containing a gas;

(3) trapping the selected ions in the linear ion trap (Q2) and exciting the trapped ions to cause collisions with the gas and fragmentation;

(4) subjecting the fragment ions to a secondary excitation, different from the first excitation to cause excitation and fragmentation of selected fragment ions; and (5) passing the ions out of the linear ion trap (Q2) and subjecting the ions to a further mass analysis to determine the mass spectrum of the ions.

2. A method as claimed in claim 1, which includes, prior to subjecting the fragment ions to the secondary excitation, applying a signal to the linear ion trap (Q2) to isolate ions having a mass-to-charge ratio in a second desired range, wherein subjecting the fragment ions to the secondary excitation comprises exciting the isolated ions having a mass-to-charge ratio in the second desired range.

3. A method as claimed in claim 2, which includes, while trapping the ions in the linear ion trap, effecting multiple cycles of:

(1) isolating ions having a mass-to-charge ratio in a further desired range; and (2) exciting the isolated ions having a mass-to-charge ratio in the further desired range to cause fragmentation.

4. A method as claimed in claim 1, 2, or 3 wherein passing the selected ions into the linear ion trap comprises passing the selected ions into the linear ion trap with sufficient energy to promote collision induced dissociation, the energy providing the excitation of the trapped ions, whereby trapping the selected ions in the linear ion trap comprises applying a signal to the linear ion trap to trap ions before subjecting the ions to the further mass analysis.

5. A method as claimed in claim 1, 2, or 3 which comprises exciting the ions in the linear ion trap by providing a signal to the linear ion trap.

6. A method as claimed in claim 1, wherein the further mass analysis is carried out in a quadrupole mass analyzer (Q3).

7. A method as claimed in claim 1, wherein the further mass analysis is carried out in a time of flight mass analyzer.

8. A method as claimed in claim 7 wherein the further mass analysis is carried out in a time of flight mass analyzer arranged with its axis perpendicular to the axis of the linear ion trap (Q2).

9. A method as claimed in claim 1 wherein each mass analysis is carried out in one of: a linear quadrupole (Q3); a linear time of flight analyzer; a reflectron time of flight analyzer: a single magnetic sector analyzer; a double focusing two sector mass analyzer having an electric sector and a magnetic sector; a Paul trap; a Wien filter; a Mattauch-Herzog spectrograph; ion cyclotron mass spectrometer; and a Thomson parabolic mass spectrometer.

10. A method as claimed in claim 6, 7, 8, or 9, wherein the first mass analysis is carried out in a quadrupole mass analyzer (Q1) which is coaxial with the linear ion trap (Q2).

11. A method as claimed in claim 1, which includes, prior to exciting the trapped ions, subjecting the trapped ions to a signal comprising a plurality of excitation signals uniformly spaced in a frequency domain and having a notch, wherein the notch covers a desired frequency band and there are no excitation signals in the frequency band of the notch, and wherein the excitation signals have sufficient magnitude to excite and eject ions except for ions having an excitation frequency within the frequency band of the notch.

12. A method as claimed in claim 11, which comprises applying a combination of signals comprising sine waves and with frequencies up to f/2, where f is the frequency of the trapping RF.

13. A method as claimed in claim 11 or 12, which includes, after selection of a desired ion, exciting the desired ion with a signal comprising a sine wave at or near the resonant frequency of the ion.

14. A method as claimed in claim 7, which includes providing an exit lens between the linear ion trap (Q2) and the time of flight device, and lowering the voltage on the exit lens to permit ions to pass into the time of flight device, the method further comprising providing a signal to a repeller grid of the time of flight device, to cause the time of flight device to scan at a desired rate.

15. An apparatus for effecting mass analysis and fragmentation of an ion stream, the apparatus comprising:

an input for an ion stream;

a first mass analyzer (Q1) at a pressure no higher than approximately $2\times10^{-5}$ torr to select ions having a mass-to-charge ratio in a desired range;

a radio frequency linear ion trap (Q2) to receive the selected ions;

a final mass analyzer; and, an auxiliary drive connected to the radio frequency linear ion trap (Q2) for effecting multiple excitation steps.

16. An apparatus as claimed in claim 15, wherein the first mass analyzer (Q1) comprises a quadrupole mass analyzer.

17. An apparatus as claimed in claim 15 or 16, wherein the final mass analyzer (Q3) comprises a quadrupole mass analyzer, and the first mass analyzer (Q1), the linear ion trap (Q2) and the final mass analyzer (Q3) are axially aligned with one another.

18. An apparatus as claimed in claim 15 or 16, wherein the final mass analyzer (Q3) comprises a time of flight device.

19. An apparatus as claimed in claim 15 or 16, wherein the linear ion trap (Q2) includes a multipole rod set.

20. An apparatus as claimed in claim 17, wherein the linear ion trap (Q2) comprises a quadrupole rod set and wherein the rods of the mass analyzers (Q1 and Q3) and of the linear ion trap (Q2) have substantially similar radii and substantially similar spacings.

21. An apparatus as claimed in claim 15, wherein each of the first analyzer (Q1) and the final analyzer (Q3) comprise one of: a linear quadrupole; a linear time of flight analyzer, a reflectron time of flight analyzer; a single magnetic sector analyzer; a double focusing two sector mass analyzer having an electric sector and a magnetic sector, a Paul trap; a Wien filter; a Mattauch-Herzog spectrograph: an ion cyclotron mass spectrometer, and a Thomson parabolic mass spectrometer.

22. An apparatus as claimed in claim 21, wherein the linear ion trap (Q2) includes a multipole rod set.

23. An apparatus as claimed in claim 15, wherein the linear ion trap (Q2) has a pair of opposed x rods and a pair of opposed y rods, wherein a main RF drive is connected to the x and y rods of the linear ion trap (Q2), and wherein the auxiliary drive is connected to at least one pair of rods of the linear ion trap (Q2).

24. An apparatus as claimed in claim 23, wherein the auxiliary drive is connected to the y rods of the linear ion trap (Q2) through a transformer, and wherein the main RF drive is connected directly to the x rods of the linear ion trap (Q2) and, through a coil of the transformer to the y rods.

25. An apparatus as claimed in claim 23, which includes an arbitrary waveform generator connected to the auxiliary drive, for applying a selected waveform to the linear ion trap (Q2) to excite ions therein.

26. A method of analyzing a stream of tons, the method comprising:

(1) subjecting a stream of ions to a first mass analysis at a pressure no higher than approximately $2\times10^{-5}$ torr, to select ions having a mass-to-charge ratio in a first desired range;

(2) passing the selected ions into a radio frequency linear ion trap (Q2) containing a gas;

(3) trapping the selected ions in the linear ion trap (Q2);

(4) subjecting the trapped ions to a signal comprising a plurality of excitation signals uniformly spaced in a frequency domain and having a notch, wherein the notch covers a desired frequency band and there are no excitation signals in the frequency band of the notch, and wherein the excitation signals have sufficient magnitude to excite and eject ions except for ions having an excitation frequency within the frequency band of the notch, which comprises applying a combination of signals having sine waves with frequencies in the range 10 to 500 kHz and spaced at 500 Hz intervals, and the frequency band of the notch has a width of 1–10 kHz and is centered on the resonant frequency of an ion of interest;

(5) exciting the trapped ions to cause collisions with the gas and fragmentation;

(6) subjecting the fragment ions to a further excitation, different from the excitation of step (5) to cause excitation and fragmentation of selected fragment ions; and (7) passing the ions out of the linear ion trap (Q2) and subjecting the ions to a further mass analysis to determine the mass spectrum of the ions.

27. A method as claimed in claim 26, which includes, after selection of a desired ion, exciting the desired ion with a signal comprising a sine wave at or near the resonant frequency of the ion.

28. A method as claimed in claim 26, wherein the further mass analysis is carried out in a quadrupole mass analyzer (Q3).

29. A method as claimed in claim 26, wherein the further mass analysis is carried out in a time of flight mass analyzer.

30. A method as claimed in claim 29 wherein the further mass analysis is carried out in a time of flight mass analyzer arranged with its axis perpendicular to the axis of the linear ion trap (Q2).

31. A method as claimed in claim 26 wherein each mass analysis is carried out in one of: a linear quadrupole (Q3); a linear time of flight analyzer; a reflectron time of flight analyzer; a single magnetic sector analyzer; a double focusing two sector mass analyzer having an electric sector and a magnetic sector, a Paul trap; a Wien filter; a Mattauch-Herzog spectrograph; ion cyclotron mass spectrometer; and a Thomson parabolic mass spectrometer.

32. A method as claimed in claim 28, 29, 30, or 31, wherein the first mass analysis is carried out in a quadrupole mass analyzer (Q1) which is coaxial with the linear ion trap (Q2).

33. A method of analyzing a stream of ions, the method comprising:

(1) subjecting a stream of ions to a first mass analysis at a pressure no higher than approximately $2\times10^{-5}$ torr, to select ions having a mass-to-charge ratio in a first desired range;

(2) passing the selected ions into a radio frequency linear ion trap (Q2) containing a gas;

(3) trapping the selected ions in the linear ion trap (Q2) and exciting the trapped ions to cause collisions with the gas and fragmentation;

(4) subjecting the fragment ions to a secondary excitation, different from the first excitation to cause excitation and fragmentation of selected fragment ions; and (5) passing the ions out of the linear ion trap (Q2) and subjecting the ions to a further mass analysis to determine the mass spectrum of the ions, the further mass analysis is carried out in a time of flight mass analyzer, and wherein passing the selected ions into the linear ion trap (Q2) is for a period of substantially 5 ms, subjecting the ions in the linear ion trap (Q2) to an excitation signal to excite and eject undesired ions is for a period of substantially 4 ms, exciting the desired ions is for a period of substantially 4 ms and passing the ions out of the linear ion trap (Q2) and scanning the time of flight device is for substantially 7 ms.

34. A method as claimed in claim 33, which includes providing an exit lens between the linear ion trap (Q2) and the time of flight device, and lowering the voltage on the exit lens to permit ions to pass into the time of flight device, the method further comprising providing a signal to a repeller grid of the time of flight device, to cause the time of flight device to scan at a desired rate.

35. A method as claimed in claim 33, which includes, prior to subjecting the fragment ions to the secondary excitation, applying a signal to the linear ion trap (Q2) to isolate ions having a mass-to-charge ratio in a second desired range, wherein subjecting the fragment ions to the secondary excitation comprises exciting the isolated ions having a mass-to-charge ratio in the second desired range.

36. A method as claimed in claim 35, which includes, while trapping the ions in the linear ion trap, effecting multiple cycles of:

(1), isolating ions having a mass-to-charge ratio in a further desired range; and (2) exciting the isolated ions having a mass-to-charge ratio in the further desired range to cause fragmentation.

37. A method as claimed in claim 33, 35, or 36 wherein passing the selected ions into the linear ion trap comprises passing the selected ions into the linear ion trap with sufficient energy to promote collision induced dissociation, the energy providing the excitation of the trapped ions, whereby trapping the selected ions in the linear ion trap comprises applying a signal to the linear ion trap to trap ions before subjecting the tons to the further mass analysis.

38. A method as claimed in claim 33, 35, or 36 which comprises exciting the ions in the linear ion trap by providing a signal to the linear ion trap.

39. A method as claimed in claim 33 wherein the time of flight mass analyzer is arranged with its axis perpendicular to the axis of the linear ion trap (Q2).

40. A method as claimed in claim 38 wherein the first mass analysis is carried out in a quadrupole mass analyzer (Q1) which is coaxial with the linear ion trap (Q2).

41. A method as claimed in claim 33, which includes, prior to exciting the trapped ions, subjecting the trapped ions to a signal comprising a plurality of excitation signals uniformly spaced in a frequency domain and having a notch, wherein the notch covers a desired frequency band and there are no excitation signals in the frequency band of the notch, and wherein the excitation signals have sufficient magnitude to excite and eject ions except for ions having an excitation frequency within the frequency band of the notch.

42. A method as claimed in claim 41, which comprises applying a combination of signals comprising sine waves and with frequencies up to f/2, where f is the frequency of the trapping RF.

43. A method as claimed in claim 42, which comprises applying a combination of signals having sine waves with frequencies in the range 10 to 500 kHz and spaced at 500 Hz intervals, and the frequency band of the notch has a width of 1–10 kHz and is centered on the resonant frequency of an ion of interest.

44. A method as claimed in claim 41, 42, or 43, which includes, after selection of a desired ion, exciting the desired ion with a signal comprising a sine wave at or near the resonant frequency of the ion.

45. A method as claimed in claim 39 wherein the first mass analysis is carried out in a quadrupole mass analyzer (Q1) which is coaxial with the linear ion trap (Q2).

* * * * *